US006182767B1

(12) United States Patent
Jackson

(10) Patent No.: US 6,182,767 B1
(45) Date of Patent: Feb. 6, 2001

(54) NOZZLE FOR A FLOOR NOZZLE SPRAY SYSTEM

(75) Inventor: Eldon D. Jackson, Hastings, MI (US)

(73) Assignee: The Viking Corporation, Hastings, MI (US)

( * ) Notice: Under 35 U.S.C. 154(b), the term of this patent shall be extended for 0 days.

(21) Appl. No.: 09/468,485

(22) Filed: Dec. 20, 1999

(51) Int. Cl.[7] ..... A62C 35/00

(52) U.S. Cl. ..... 169/16; 169/37; 239/201; 239/208; 244/114 R; 52/1

(58) Field of Search ..... 239/201, 202, 239/203, 207, 208, 288, 288.3; 169/5, 11, 14, 15, 16, 17, 37, 61; 244/114 R; 52/1, 302.1, 660, 664; 404/2, 3

(56) References Cited

U.S. PATENT DOCUMENTS

| | | | | |
|---|---|---|---|---|
| 1,826,072 | * | 10/1931 | Hamilton | 169/17 |
| 2,059,190 | * | 11/1936 | Allen | 169/11 |
| 2,196,592 | | 4/1940 | Lowe et al. | 169/17 |
| 3,583,637 | | 6/1971 | Miscovich | 239/203 |
| 3,713,492 | | 1/1973 | Forrest | 169/2 R |
| 3,864,887 | * | 2/1975 | Arens | 52/664 |
| 4,181,179 | * | 1/1980 | Batte | 169/16 |
| 4,202,646 | | 5/1980 | Herstad | 404/36 |
| 4,657,086 | | 4/1987 | Aanensen | 169/54 |
| 4,845,629 | * | 7/1989 | Murga | 169/61 |
| 5,667,018 | | 9/1997 | Hone et al. | 169/54 |
| 6,047,897 | * | 4/2000 | Ueno et al. | 239/202 |

* cited by examiner

*Primary Examiner*—Andres Kashnikow
*Assistant Examiner*—Dinh Q. Nguyen
(74) *Attorney, Agent, or Firm*—Van Dyke, Gardner, Linn & Burkhart, LLP

(57) ABSTRACT

A floor nozzle for a floor fire suppressant system includes a body and a deflector which is supported on the body. The body includes a transverse passage and a body flange. The transverse passage defines an inlet opening and an outlet opening, with the body flange extending around the outlet opening. The inlet opening is provided for coupling to a fire suppressant supply system. The deflector is spaced from the outlet opening and includes a deflector flange with a plurality of projecting members which extend from the deflector flange toward the body flange. Projecting members are radially spaced around the outlet opening to form a plurality of passageways through which the fire suppressant exiting the outlet opening flows to form a generally lateral radial pattern for delivering fire suppressant to the floor area. The deflector and the body are adapted to support at least a portion of the weight of an aircraft riding over the flange. A floor fire suppressant system for a floor area of an aircraft facility includes a floor grating for positioning over a trench of the floor area, and a nozzle. The nozzle includes a body with a transverse passage defining an inlet opening and an outlet opening, with the inlet opening for communicating with a fire suppressant supply pipe. The nozzle is supported by the floor grating and includes a deflector supported on the body for dispersing fire suppressant exiting from the outlet opening in a generally lateral radial pattern. The deflector is adapted to carry at least a portion of the weight of an aircraft riding over the deflector.

35 Claims, 17 Drawing Sheets

NOZZLE FOR A FLOOR NOZZLE SPRAY SYSTEM

TECHNICAL FIELD AND BACKGROUND OF THE INVENTION

The present invention relates to a spray system and, more particularly, to a floor spray system which is mounted in floor trenches of a target area, such as an airplane hanger floor, a flight deck, or the like, for delivering fire suppressant to the floor area.

Conventional floor fire protection systems for aircraft runways or the like include a network of pipes which are often positioned beneath the runway. These systems typically include articulating discharge nozzles which move from a recessed position below the ground level to an elevated position when the system is actuated, such as disclosed in U.S. Pat. No. 3,583,637 to Miscovich. Aircraft hangers are typically protected from flammable liquid fires using AFFF Foam, which is dispersed from oscillating water powered monitors that spray foam to the area under the wing areas of the aircraft. These oscillating monitors include a fog type spray nozzle which have a parabolic cone spray pattern and are fixed in one position and spray over the floor area due to the oscillating motion. As these oscillating monitors require mechanical operation, they must be maintained so that the setting of the monitor remains correct. Furthermore, these monitors and articulating nozzles must be positioned away from the travel of the aircraft. As a result, the respective discharge nozzles must deliver fire suppressant to a large area in order to cover the entire floor area. As a result, the spray from the monitor or nozzles may not be as effective and the angle which the fire suppressant is delivered exposes the aircraft to potential contact with the fire suppressant, which may cause damage to the aircraft or equipment. In addition, because of the spray pattern, aircraft or equipment in the vicinity may form an obstruction which can block the flow of the fire suppressant to the fire area.

Other systems, incorporate fixed nozzles, such as disclosed in U.S. Pat. No. 2,196,592 to Lowe. Lowe discloses fixed position nozzles that are recessed below the floor area. However, in order to produce a spray that covers a large area, these nozzles project the fire suppressant vertically from the floor. As a result, the fire suppressant also may contact the aircraft or equipment in the vicinity of the nozzle and cause damage.

Other systems which have been developed for helicopter landing platforms, include a network of pipes with nozzles that are in a fixed position and are positioned beneath a grating structure. The fire suppressant rises through the grating to deliver the fire suppressant to the deck of the platform. However, the response time for this type of system is slower than other conventional systems because the space between the grating and the ground level supporting the grating must fill up first before the fire suppressant flows through the grating and, further, these platforms are not well suited for most heavy aircraft equipment.

Consequently, there is a need for a fire suppressant system which can deliver fire suppressant to a floor area of a hanger, flight deck, or the like, which minimizes the contact between the fire suppressant and the aircraft supported on the floor area and yet delivers a fire suppressant which can quickly and totally cover the floor area in the event of a fire. Moreover, there is a need for a fire suppressant system in which the aircraft in the area of the fire will not pose obstructions to the delivery of the fire suppressant.

SUMMARY OF THE INVENTION

The present invention provides a floor fire suppressant system that is particularly suitable for extinguishing fires on a large floor area, such as a floor area of a hanger, platform, runway or other aircraft areas. The fire suppressant system delivers fire suppressant to the floor area in a manner to minimize contact with the aircraft stored or positioned in the floor area. The fire suppressant system includes a nozzle and floor grating assembly which is capable of resisting heavy loads such as the weight of an aircraft or equipment and maintains operation, on at least a limited basis, even with the aircraft parked over the nozzle. In this manner, the fire suppressant system of the present invention can operate without obstruction from vehicles in the immediate or nearby vicinity of a nozzle in floor grating assembly.

In one form of the invention, a floor nozzle for the floor fire suppressant system includes a body and a deflector which is supported on the body. The body includes a body flange and a transverse passage, which defines an inlet opening and an outlet opening. The body flange extends around the outlet opening, with the inlet opening for coupling to a fire suppressant supply pipe. The deflector is spaced from the outlet opening and includes a deflector flange and, further, a plurality of projecting members which extend from the deflector flange toward the body flange. The projecting members are radially spaced around the outlet opening to form a plurality of passageways through which the fire suppressant exiting the outlet opening flows to form a generally lateral radial pattern for delivering fire suppressant to the floor area. The deflector and the body of the nozzle are adapted to support at least a portion of the weight of an aircraft riding over the flange.

In one aspect, the projecting members rest on the body flange to provide uniform support to the deflector flange. In other aspects, each of the projecting members comprises an elongate plate member, which is aligned along a radial line extending outwardly from the outlet opening. Preferably, each plate member includes side walls, with the passageways being defined between side walls. In further aspects, the side walls of the plate members are aligned along radial lines extending outwardly from the outlet opening.

In another form of the invention, a floor nozzle for a floor fire suppressant system includes a body having a transverse passage defining an inlet opening and an outlet opening, with the inlet opening for coupling to a fire suppressant supply pipe. The nozzle further includes a deflector which is supported on the body and spaced from the outlet opening. The deflector includes an outer perimeter and a plurality of projecting members projecting toward the outlet opening.

The projecting members extend inwardly from the outer perimeter of the deflector and are radially spaced around the outlet opening to form passageways through which the fire suppressant flows such that the fire suppressant exiting the outlet opening is dispersed in a generally lateral radial pattern for delivering fire suppressant to the floor area.

In other aspects, the deflector includes a deflector flange, with the projecting members extending downwardly toward the outlet opening from the deflector flange. Preferably, the deflector flange is substantially solid. In other aspects, the projecting members rest on the body of the nozzle.

In yet further aspects, each of the projecting members comprises an elongate finger, with each of the elongate fingers including radiused first and second ends. The first ends are radially inward of the second ends toward the outlet opening, with the radiused first and second ends producing a venturi effect to provide a uniform distribution of the fire suppressant.

In another form of the invention, a floor fire suppressant system for a floor area of an aircraft facility includes a floor grating for positioning over a trench of the floor area and a nozzle. The nozzle includes a body with a transverse passage defining an inlet opening and an outlet opening, with the inlet opening for communicating with a fire suppressant supply pipe. The nozzle is supported by the floor grating and includes a deflector supported on the body for dispersing fire suppressant exiting from the outlet opening in a generally lateral radial pattern. The deflector is adapted to carry at least a portion of the weight of an aircraft riding over the deflector.

In one aspect, the floor grating includes a base, which is sized for spanning over the trench. The base includes a recessed portion and a transverse opening extending through the recessed portion. The body of the nozzle is supported in the recessed portion and communicates with the supply pipe through the transverse opening. In further aspects, a portion of the body of the nozzle extends through the transverse opening for communicating with the fire suppressant supply pipe.

In other aspects, the deflector includes a deflector flange, which is generally flush with the upper surface of the base of the floor grating when the body is supported in the recessed portion. Preferably, the deflector flange is substantially solid to provide a deflecting surface for the fire suppressant.

In further aspects, the recessed portion includes an outer perimeter, with the deflector flange having an outer perimeter spaced radially inward of the outer perimeter of the recessed portion to provide a passageway therebetween for the fire suppressant to flow through to form the lateral radial pattern. Preferably the recessed portion includes a tapered outer perimeter portion. For example, the tapered outer perimeter portion may be angled in a range of 5 degrees to 20 degrees with respect to the upper surface of the base. Preferably, the tapered portion is angled about 15 degrees with respect to the upper surface of the base.

Advantages provided by this invention include a nozzle that can deliver fire suppressant in a generally lateral radial pattern while minimizing the height of the spray to avoid contact of the fire suppressant with aircraft or equipment. Furthermore, the nozzle delivers fire suppressant without being hampered by vehicles or equipment in close proximity or on top of the nozzles.

These and other objects, advantages, purposes, and features of the invention will become more apparent from the study of the following description in conjunction with the drawings.

DETAILED DESCRIPTION OF THE PREFERRED EMBODIMENTS

Figure 1:
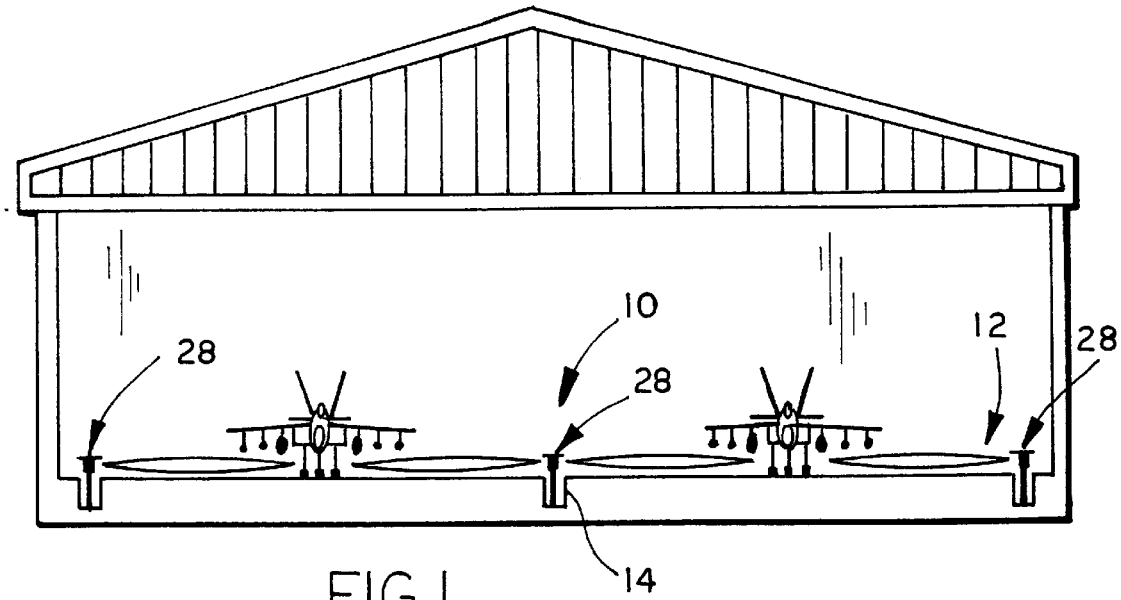
FIG. 1 illustrates a floor fire suppressant system of the present invention in an aircraft hanger.
Figure 2:
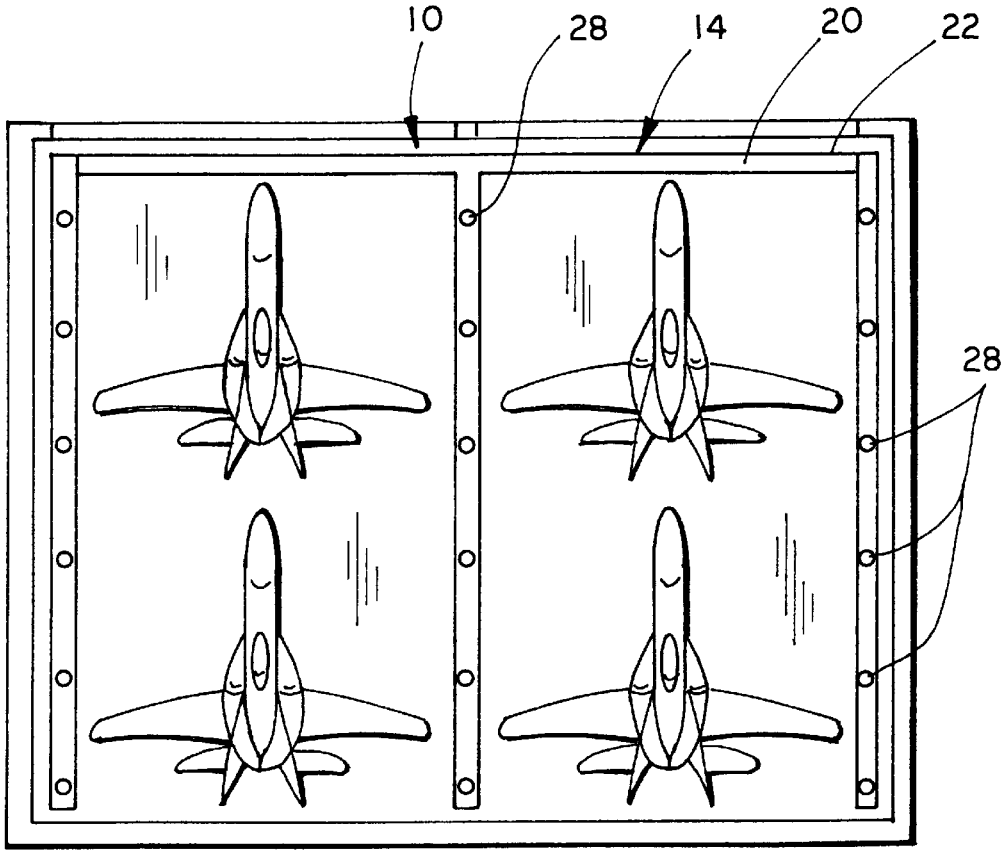
FIG. 2 is a plan view of the air hanger of FIG. 1 illustrating the floor area with a trench covered by floor grating of the fire suppressant system of the present invention.

Referring to FIG. 1, the numeral 10 generally designates a floor fire suppressant system of the present invention. Floor fire suppressant system 10 is particularly suitable for extinguishing fires in a floor area 12 of a hanger, or other aircraft areas including, for example, a helicopter deck, a runway, or the like. Floor fire suppressant system 10 delivers sufficient fire suppressant to the floor area to totally flood the floor area while distributing the fire suppressant to the area in a manner to minimize contact with the aircraft stored or positioned in the floor area. Furthermore, the fire suppressant system of the present invention provides a nozzle and floor grating assembly which is capable of resisting heavy loads such as the weight from an aircraft wheel, a wheel of a fire fighting vehicle, etc., and will maintain operation on at least a limited basis even with the wheel of the vehicle parked on top of the nozzle. In this manner, the fire suppressant system of the present of the invention can operate without obstruction from the vehicles in the vicinity of the floor area including those that are positioned over the nozzle and floor grating assembly.

Figure 3:
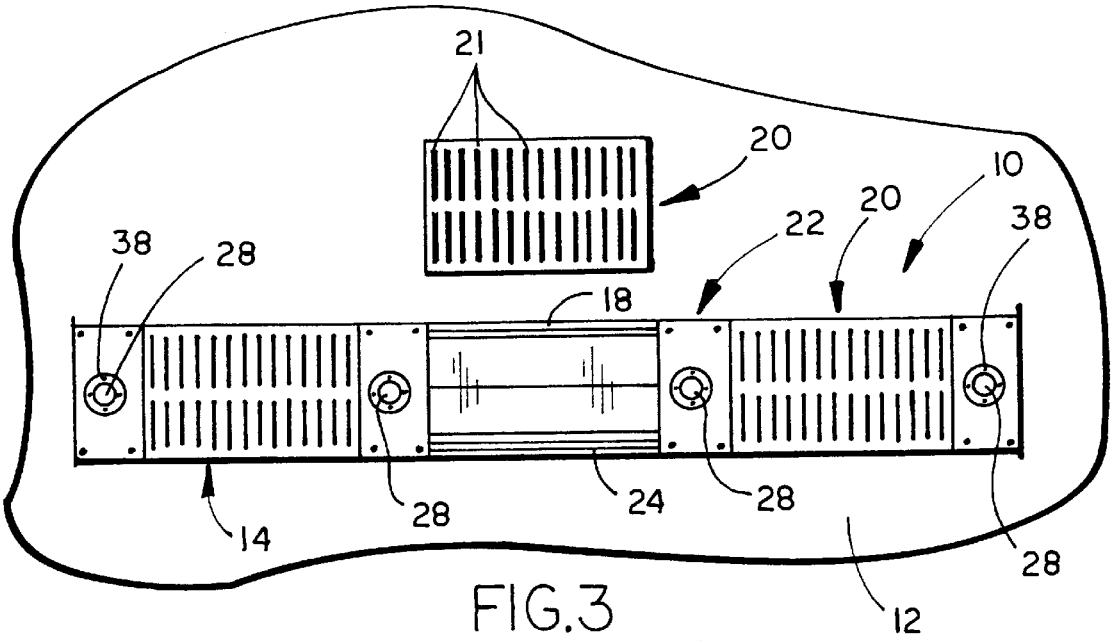
FIG. 3 is an enlarged plan view of a section of the trench of the floor area of FIG. 2 with a portion of the grating removed.
Figure 4:
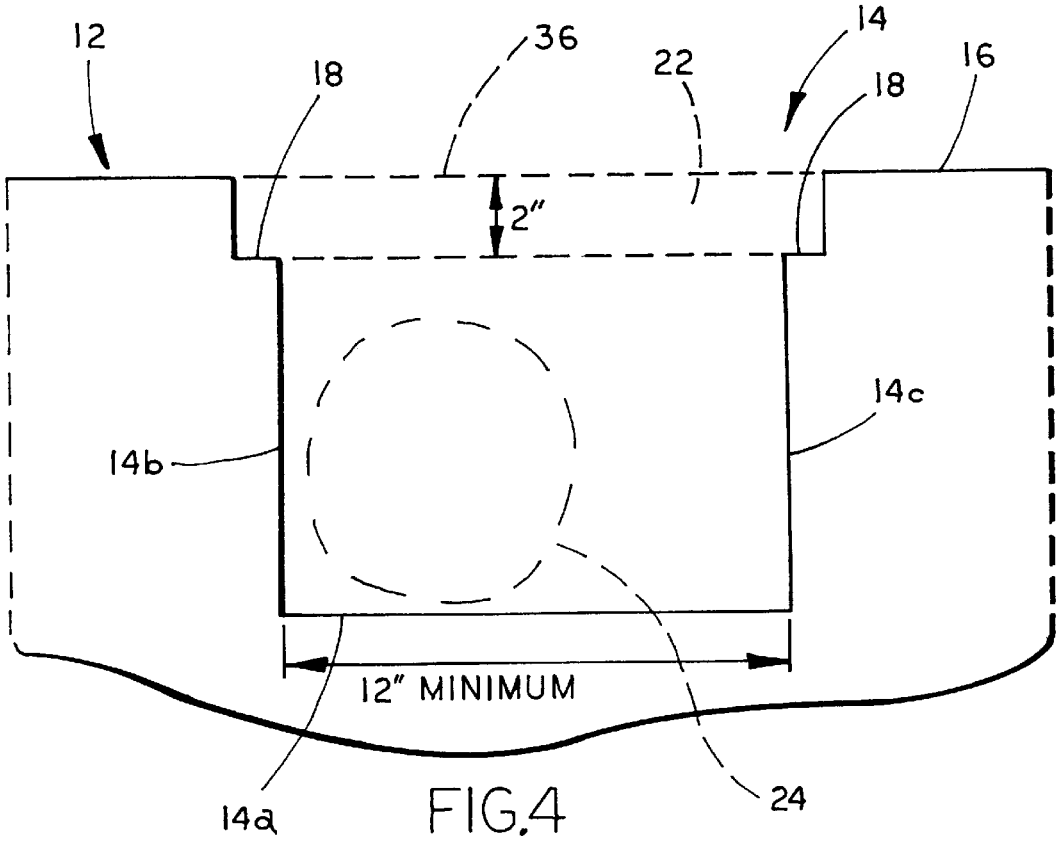
FIG. 4 is an enlarged cross-section view of the trench of FIG. 3, with the fire suppressant system and floor grating removed.

Referring to FIGS. 1–5, floor fire suppressant system 10 is designed for positioning in a trench 14 of the target floor area. As best seen in FIG. 4, trench 14 extends below floor surface 16 and includes shelves or support surfaces 18 for supporting thereon floor grating 20 and 22 (FIG. 3). Grating 20 may be of conventional design with a plurality of drain openings 21 extending therethrough to permit fire suppressant run off and debris to drain from the floor area. Grating 22 is designed to support a nozzle 28 of the present invention in a manner to permit nozzle 28 to deliver fire suppressant to the target area unhampered by aircraft, equipment or other potential obstructions, as will be more fully described below.

Trench 14 includes a bottom wall 14*a* and opposed side walls 14*b* and 14*c*, with bottom wall 14*a* spaced from floor surface 16 to permit positioning of a supply pipe or line 24 in trench 14 such that supply pipe 24 is spaced beneath floor surface 16. Side walls 14*b* and 14*c* are preferably spaced apart greater than the supply pipe diameter to permit access to pipe 24. For example, side walls 14*b* and 14*c* of trench 14 may be spaced *18* inches to 22 inches apart for a six inch supply pipe, so that a person servicing the supply pipe can stand on bottom wall 14*a* and have access to the supply pipe. It should be understood, however, that these dimensions are exemplary only and are not intended to limit the scope of the invention.

Supply pipe 24 delivers fire suppressant to a plurality of nozzles 28 which are positioned along trench 14 to disperse the fire suppressant in a generally lateral radial pattern outwardly from the respective nozzle to provide a radial coverage of 360° or less. For example, nozzles may be provided at 25 to 35 foot spacings. In preferred form, supply pipe 24 delivers an AFFF foam to nozzles 28. It should be understood, however, that supply pipe 24 may alternatively supply water to nozzles 28. As will be more fully described below, each nozzle 28 delivers fire suppressant in a manner to minimize the height of the fire suppressant spray. For example, nozzles 28 preferably deliver fire suppressant over an area having a radius of approximately 25–26 feet with a maximum height in a range of about 12 inches to 18 inches. More preferably, nozzles 28 deliver fire suppressant with a maximum height of 12 inches or less. Nozzle 28 is designed to apply water or water foam solution such as aqueous film forming foam (AFFF) to the floor area. AFFF foam is applied to flammable liquid fires to suppress fire by covering the fire with film that depletes oxygen and cools the fire in order to extinguish the fire.

Figure 5:
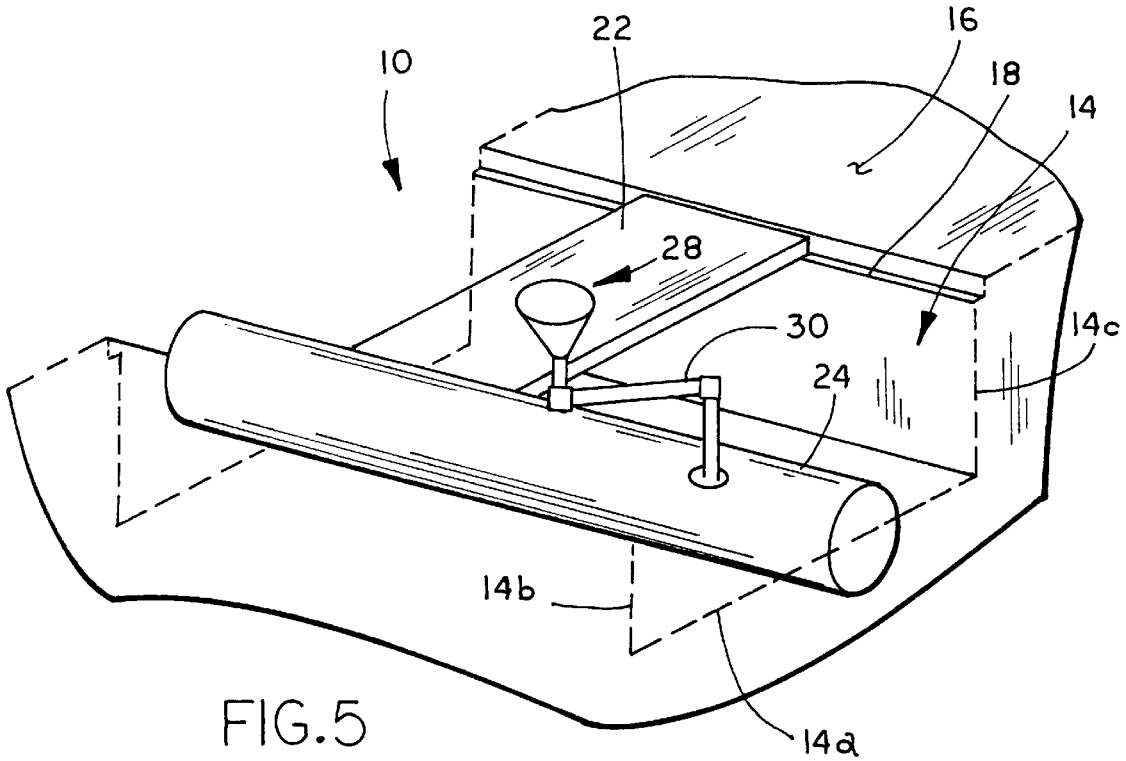
FIG. 5 is a perspective view of a section of the fire suppressant system of the present invention positioned in a trench of the floor area.

As illustrated in FIG. 5, nozzles 28 are coupled to supply pipe or line 24 by piping 30 and are supported in grating 22. Grating 22 is designed and sized to support the weight of heavy equipment including aircraft, maintenance equipment and normal heavy loads which could pass over grating 22. Grating 22 is preferably designed to mount nozzle 28 generally flush with the upper surface of the floor area and, further, includes a sufficient strength to support about 350 pounds per square inch and, more preferably includes drainage and space to prevent blockage of nozzle 28, as will be described in greater detail below.

Figure 6:
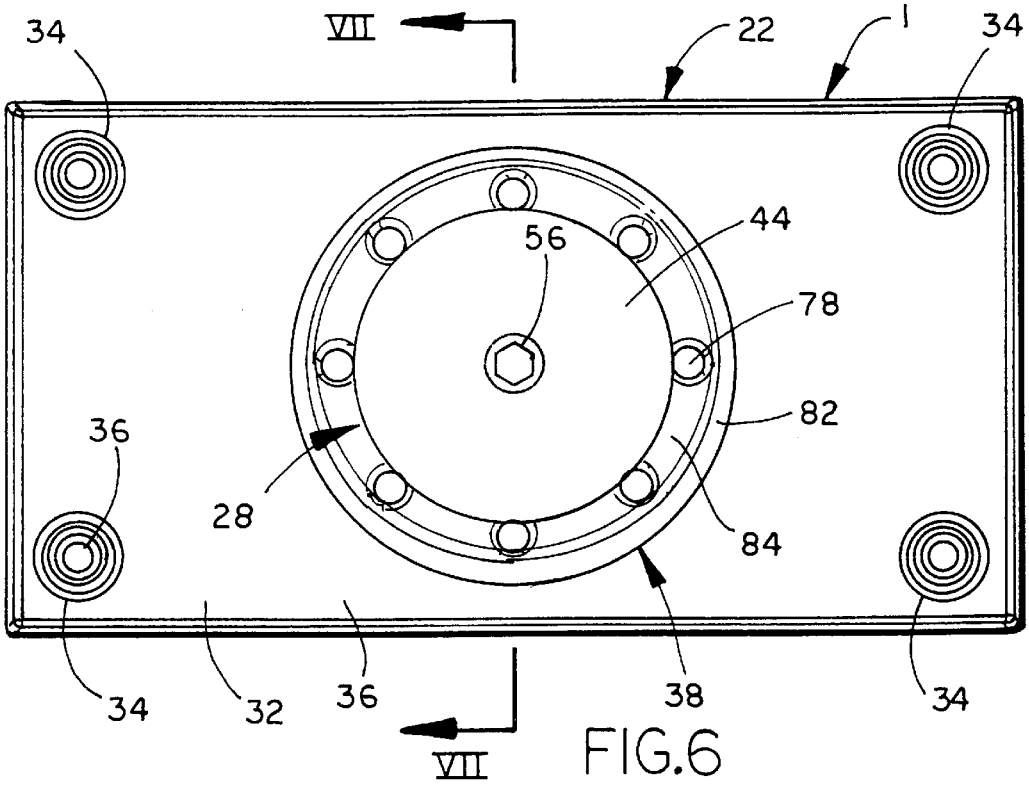
FIG. 6 is an enlarged plan view of one section of the floor grating and nozzle of the fire suppressant system of FIGS. 1–5.

Referring to FIG. 6, floor grating 22 includes a generally solid base 32 which spans over trench 14 and rests on shelves 18. Preferably, grating 22 is fixed to shelves 18 using a standard "X" frame system used in concrete so that grating 22 is flush or recessed below floor surface 16. Base 32 includes an upper surface 36 which is generally flush with floor surface 16 when grating 22 is supported on shelves 18. As noted above, base 32 is preferably rigidly supported on shelves 18 and includes a plurality of recessed mounting openings 34 which receive bolts 36 for securing grating 22 to shelves 18 of trench 14 as noted above.

Figure 6A:
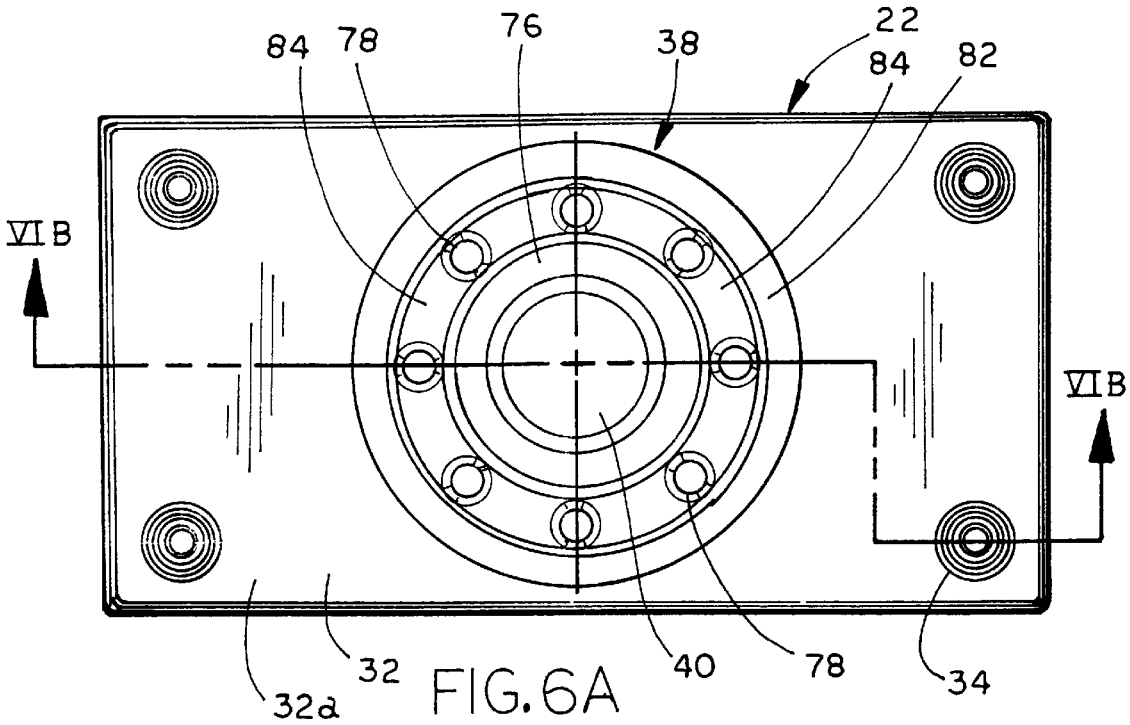
FIG. 6A is a plan view of the grating section of FIG. 6 with the nozzle of the floor suppressant system of the present invention removed.

Nozzles 28 are mounted in base 32 and are, preferably, mounted generally flush with an upper surface 36 of base 32 so that nozzles 28 will lie generally flush with floor surface 16 and will not project outwardly from grating 22 (FIG. 7) and, therefore, not form an obstruction for vehicles or the like. Referring to FIG. 6A, base 32 includes a recessed portion or cavity 38 with a centrally located transverse opening 40 which supports nozzle 28. Referring to FIGS. 7–17, nozzle 28 includes a base or body 42 and a deflector 44, which is supported on a central web or support 46 of base 42. When recessed in cavity 38, deflector 44 lies generally flush with upper surface 36 of body 32 and, further, with floor surface 16. Base 42 includes a transverse passage 47 which defines an inlet opening 50 and an outlet opening 54 and includes a mounting portion 48, which is in communication with supply pipe 24 through delivery pipe or line 30. Mounting portion 48 is preferably threaded or grooved for coupling to delivery pipe 30 as is conventionally known.

Body 42 further includes a body flange 52 which extends around outlet opening 54. Body flange 52 supports nozzle 28 in recessed cavity 38, as will be more fully described below. Deflector 44 includes a deflector flange 58 which is spaced from outlet opening 54. Flange 58 is substantially solid except for a central mounting opening described below and is, therefore, substantially impervious and provides a solid deflecting surface for the fire suppressant. To further deflect and, moreover, direct the fire suppressant, deflector 44 includes a plurality of projecting members 60 which extend from deflector flange 58 to body flange 52 and which preferably rest on upper surface 52*a* of flange 52 to thereby define a plurality of radial passageways 62 through which the fire suppressant flows to form the generally lateral radial pattern. By resting on body flange 52, projecting members 60 provide uniform support to deflector 44.

Figure 7:
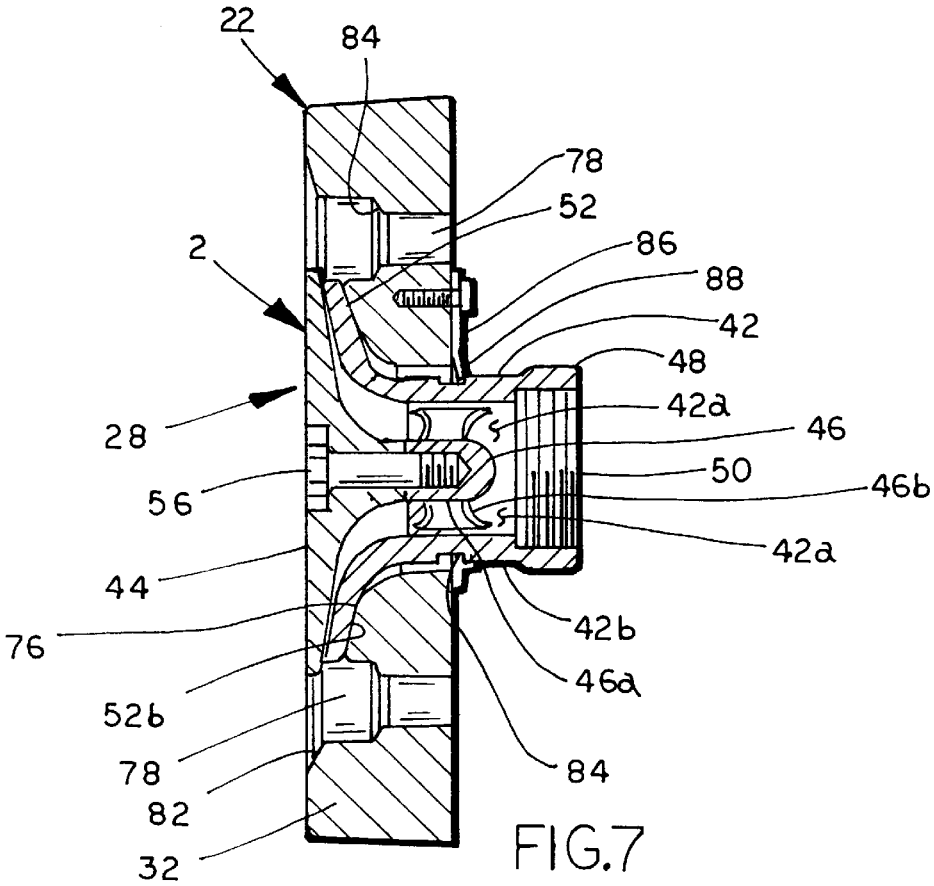
FIG. 7 is a cross-section view taken along line VII—VII of FIG. 6.
Figure 9:
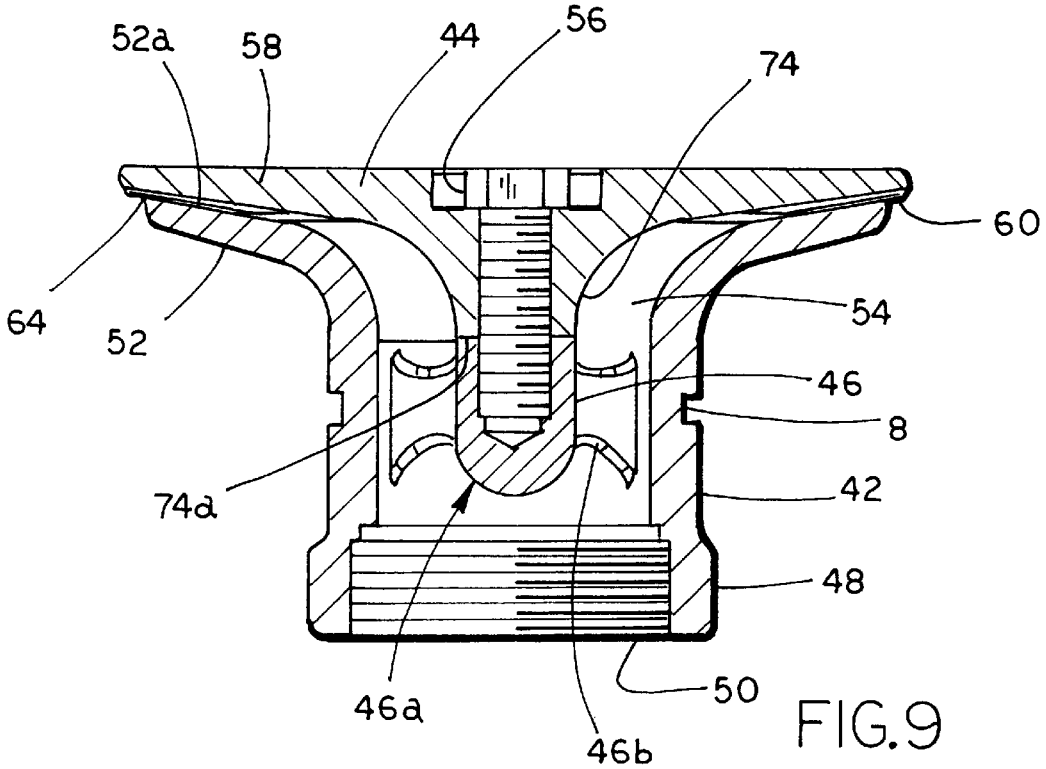
FIG. 9 is a cross-section view taken along line IX—IX of FIG. 8.
Figure 10:
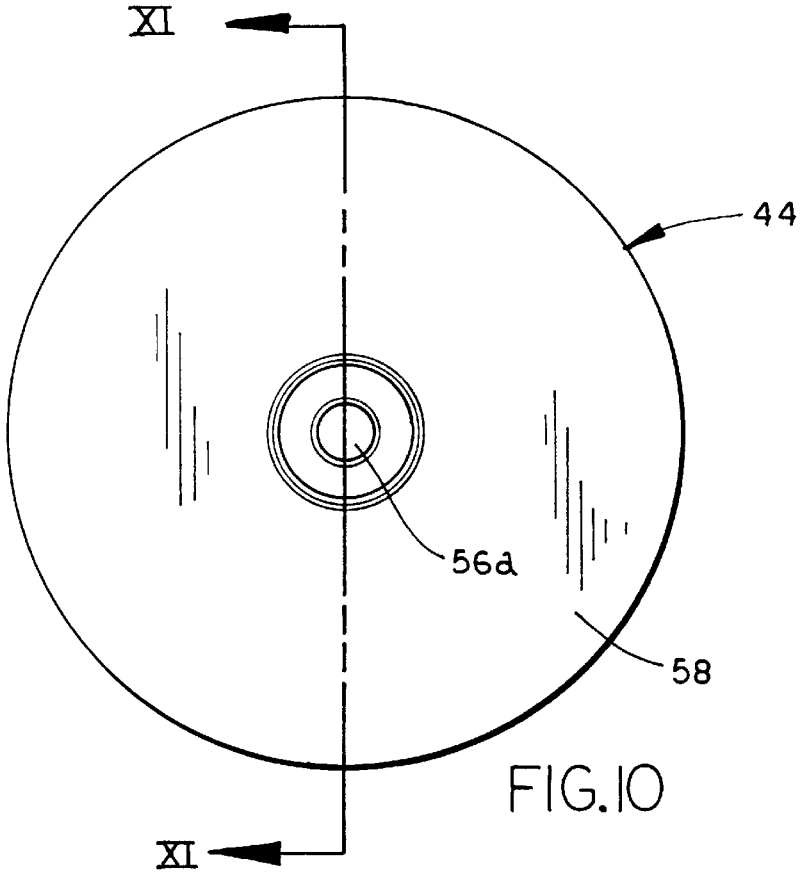
FIG. 10 is a plan view of a deflector of the nozzle of FIGS. 7–9.
Figure 15:
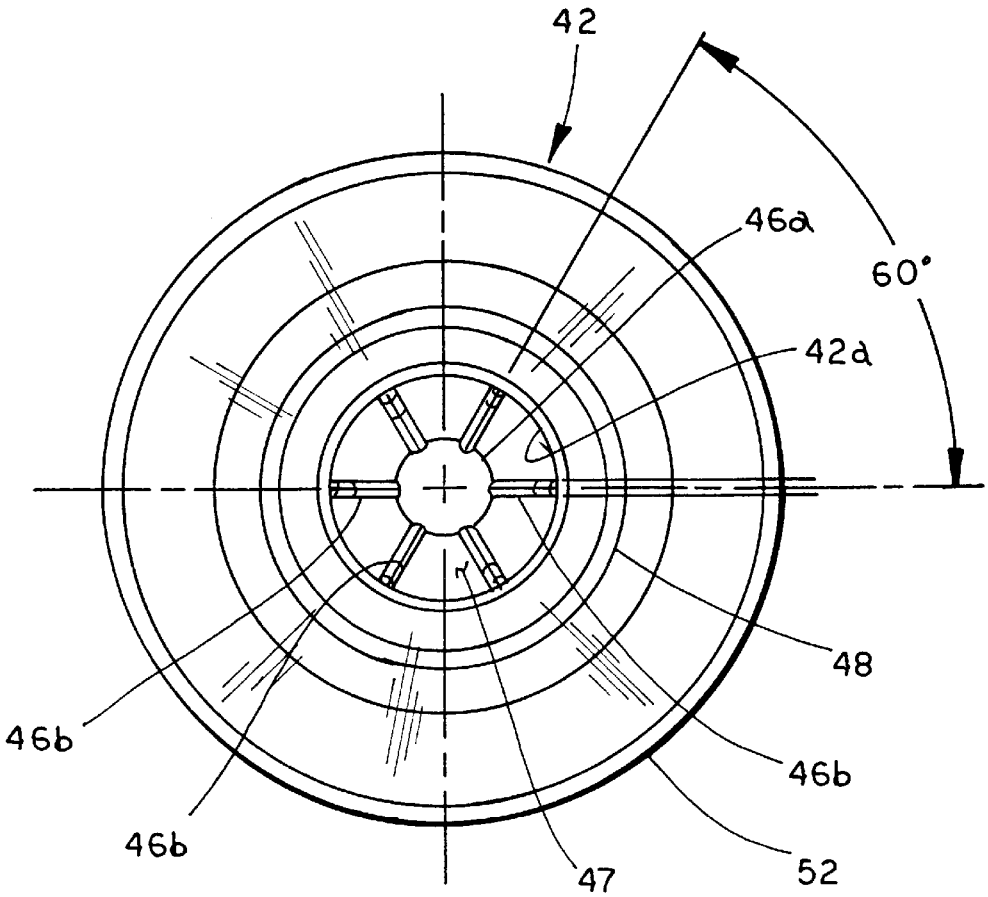
FIG. 15 is a bottom plan view of the base of the nozzle viewed from the inlet opening.
Figure 16:
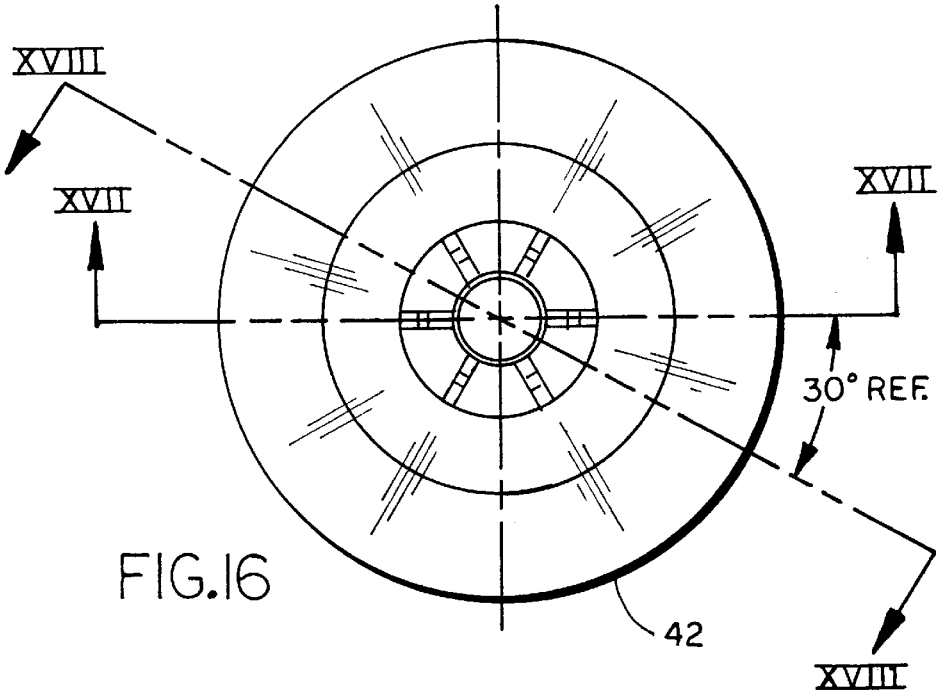
FIG. 16 is a top plan view of the nozzle base of FIG. 14 as viewed from the outlet opening of the nozzle.
Figure 17:
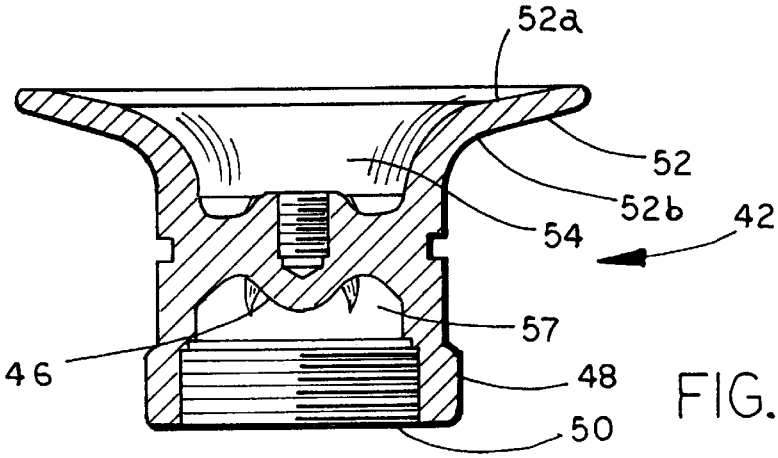
FIG. 17 is a cross-section view taken along line XVII—XVII of FIG. 16.
Figure 18:
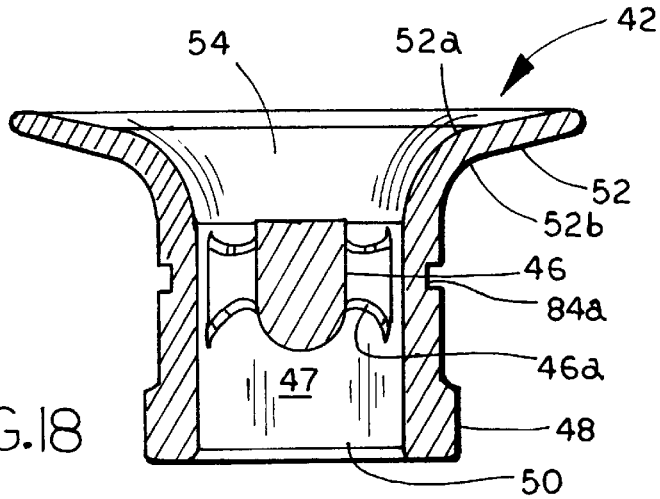
FIG. 18 is a cross-section view taken along line XVIII—XVIII of FIG. 16.
Figure 20:
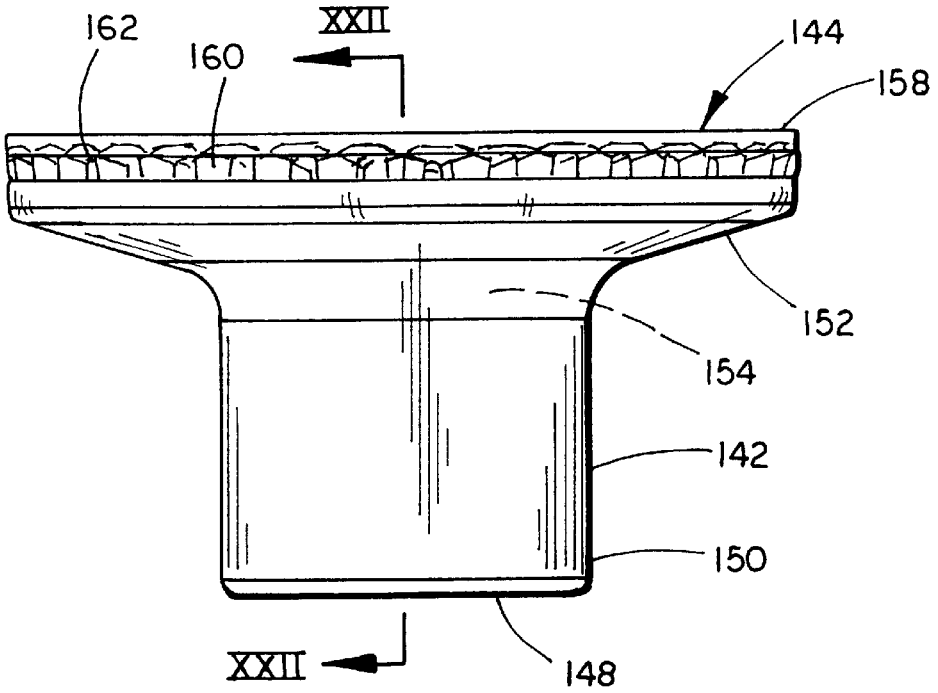
FIG. 20 is an elevation view of the nozzle of FIG. 19.

Deflector 44 is mounted to central support 46 by mounting web 74 and a threaded fastener 56 which extends through central mounting opening 56*a* and web 74 and is preferably counter sunk in central opening 56*a* of deflector 44. Mounting web 74 is preferably shaped to minimize friction loss of the exiting fire suppressant from outlet opening 54. Preferably, a resilient washer material is placed between mounting web 74 and support web 46, which prevents rotation of deflector 44 due to human contact and, furthermore, due to torque loads which may be caused from vehicles; however, the resilient washer material preferably breaks free to permit rotation to prevent damage to nozzle 28 in the even that heavy torque loads caused from turning or accelerating vehicles are applied. In the illustrated embodiment, central web 46 comprises a cylindrical body 46*a*, which is preferably centrally located in body 42 and in passage 47 and is supported in passage 47 by six radial arms 46*b*. It should be understood, however, the number of radial arms may be modified. Radial arms 46*b* extend from body 46*a* to inner surface 42*a* of body wall 42*b* (FIGS. 7, 9 and 15). Central web 46 is also preferably shaped to minimize friction loss of the fire suppressant flowing through transverse passage 47.

Figure 12:
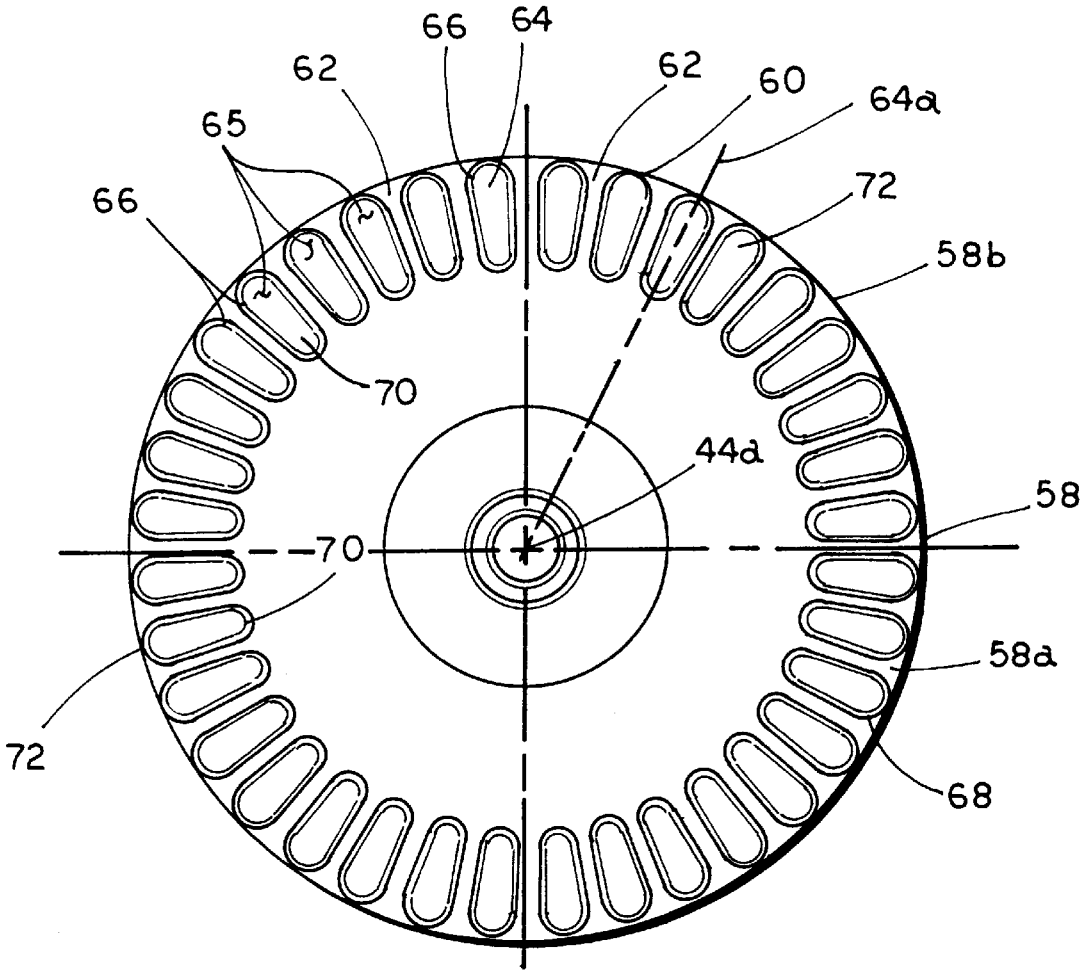
FIG. 12 is a bottom plan view of the deflector of FIG. 10.
Figure 13:
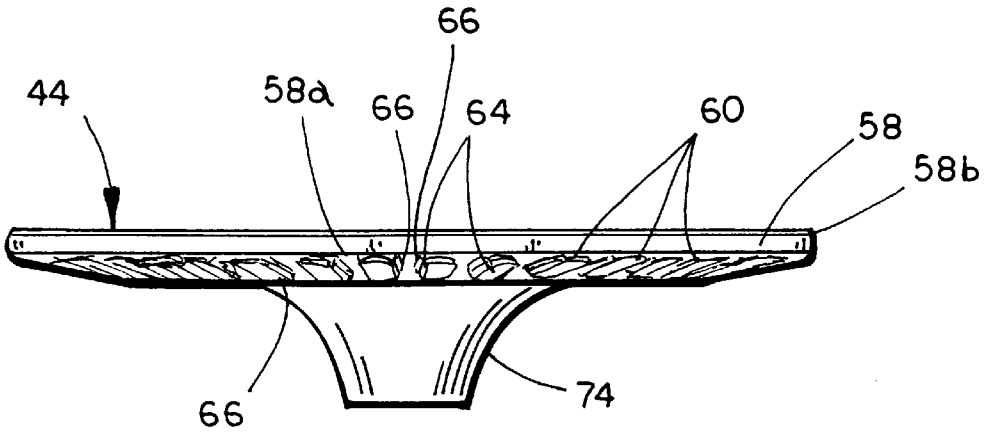
FIG. 13 is a side elevation view of the deflector of FIG. 10.
Figure 14:
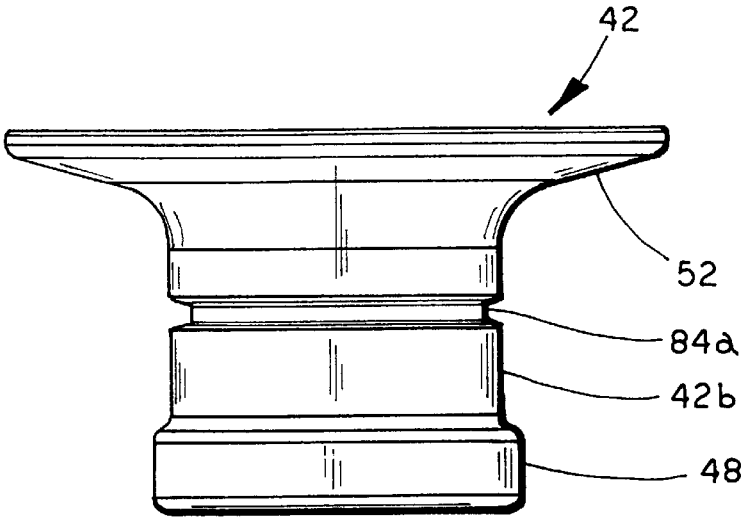
FIG. 14 is an elevation view of the base or body of the nozzle of FIG. 8.

As best seen in FIG. 12, projecting members 60 are aligned along radial lines which extend radially outward from the center 44*a* of deflector 44 and, furthermore, along radial lines which extend outwardly from the center of outlet opening 54, as will be understood from FIG. 9. Projecting members 60 comprise elongate spray fingers or teeth formed from plate members 64. Each plate member 64 includes a longitudinal extent aligned along an axis 64*a* which aligns with a respective radial line extending radially outward from center 44*a* and opening 54. Nozzles 28 are sized for application to a protected area using a "K" factor which is dependent on the inlet supply pressure to each nozzle. The flow rate is determined by the available pressure to each nozzle using an industry standard formula. Flow in GPM= "K"×(Pressure (PSI)$^{1/2}$. The flow rate of nozzle 28 is designed to provide at least a 0.1 Gpm per application density over an area of coverage. Preferably the "K" factor of nozzle 28 has a range of about 25–50.

Spray teeth 60 are spaced to provide multiple spray jets close together, with each spray jet providing a high velocity foam or water solution that causes multiple droplets sizes and effects the adjacent spray tooth. This provides a solid pattern and multiple droplet size for uniform distribution of the water or foam solution. Each plate member 64 includes planar bearing surfaces 65 for resting on flange 52 and, further, side walls 66 which define passageways 62 therebetween. Plate members 64 are cast to lower surface 66 of flange 54 by mounting members 68 which, as shown in FIG. 12, have a similar profile to plate member 64 but are slightly enlarged to provide tapered transition walls between side wall 66 and lower surface 58*a* of flange 58 to minimize the friction loss of the exiting fire suppressant. In preferred form, plate members 64 include semi-circular or radiused first and second opposed ends 70 and 72, with second end 72 being generally aligned with outer perimeter 58*b* of flange 58. In preferred form, the radius of first end 70 is smaller than the radius of the outer end 72 so that side walls 66 extend along respective radial lines extending from outlet opening 54. Radiused ends 70 and 72 produce a venturi effect between each projecting member 60 which pulls the fire suppressant pattern together to form a uniform distribution and, furthermore, provides multiple fire suppressant droplet sizes and velocities. From the foregoing description, it can be appreciated that nozzle 28 has no moving parts. Furthermore, deflector 44 is supported by spray teeth 60 and center web 46 of base 42 and, therefore, has uniform support at its outer edge which results in deflector 44 being able to accept heavy vertical weight.

Figure 11:
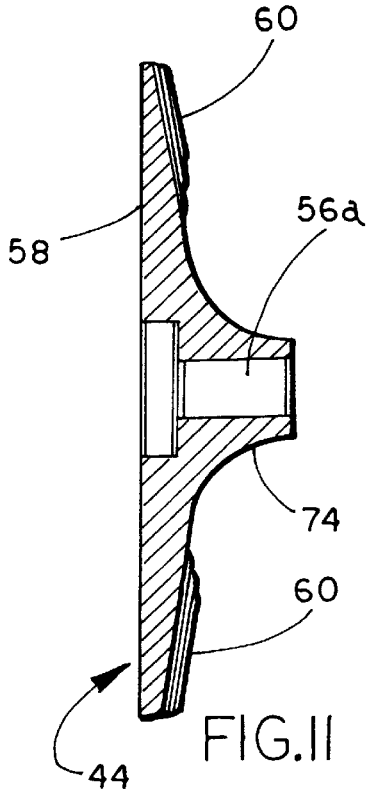
FIG. 11 is a cross-section view taken along line XI—XI of FIG. 10.

Referring to FIG. 11, inner surface 58*a* of deflector flange 58 is angled to radially direct the flow of the fire suppressant in a manner to maintain a maximum lateral trajectory and, further, to minimize the height of the spray from the floor area. In preferred form, the maximum height of the spray is in a range of about 12 inches to 18 inches and, more preferably, less than 12 inches. In preferred form, inner surface 58*a* of flange 58 is angled in a range of 10 to 15 degrees from horizontal (as used herein horizontal refers to the upper surface of deflector 44), more preferably approximately 10 degrees from horizontal so that the spray has a maximum lateral distance of approximately 25 to 26 feet. For example, typical "K" factors covered by nozzle 28 can range from 14 for 180 degree pattern to 50 for a 360 degree coverage. Preferably, the inlet pressure range to achieve the desired "K" factor is from about 40 psi to 100 psi.

Figure 6B:
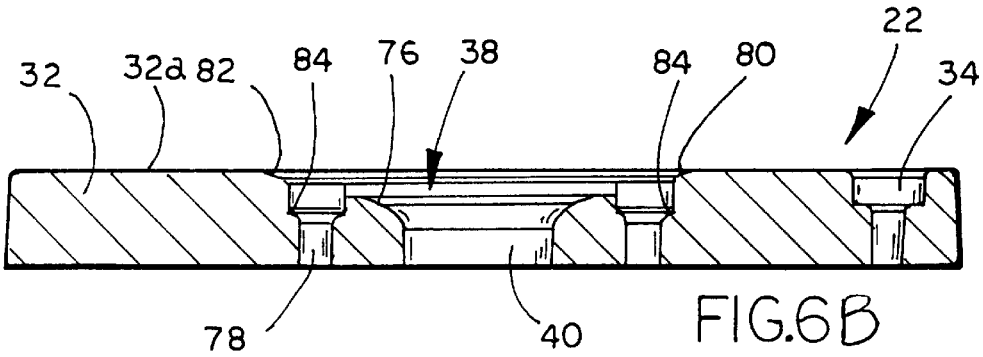
FIG. 6B is a cross-sectional view taken along line VIB—VIB of FIG. 6A.

Referring again to FIG. 6B, recessed portion or cavity 38 includes an annular tapered support surface 76 on which body flange 52 rests. Body flange 52 includes a lower surface 52*b* which is preferably angled to match tapered surface 76 so that there is uniform support for body flange 52 by grating 22. Base 32 preferably includes a plurality of transverse drainage openings 78 which are positioned around body flange 52 in an annular groove 84. Drainage openings 78 provide drainage of excess fire suppressant or debris to reduce obstruction to nozzles 28 so as not to interfere with the operation of nozzle 28. Tapered support surface 76 includes a tapered annular outer perimeter surface 80 which is spaced radially outward from nozzle 28 and deflector 44 which allows the fire suppressant spray to pass without obstruction from nozzle 28.

In the illustrated embodiment, base 42 of nozzle 28 includes an annular groove 84, which permits attachment of nozzle 28 to grating 22. In this manner, nozzles 28 may be permanently positioned in floor 12. Referring to FIG. 7, groove 84 receives one or more clips 86. Clips 86 are secured on one end to base 32 and include a projecting flange 88 which extends into groove 84 to secure nozzle 28 to grating 22. In this manner, clips 86 locate and level deflector 44 with upper surface 36 of base 32 and rigidly secure nozzle 28 to grating 22.

Figure 19:
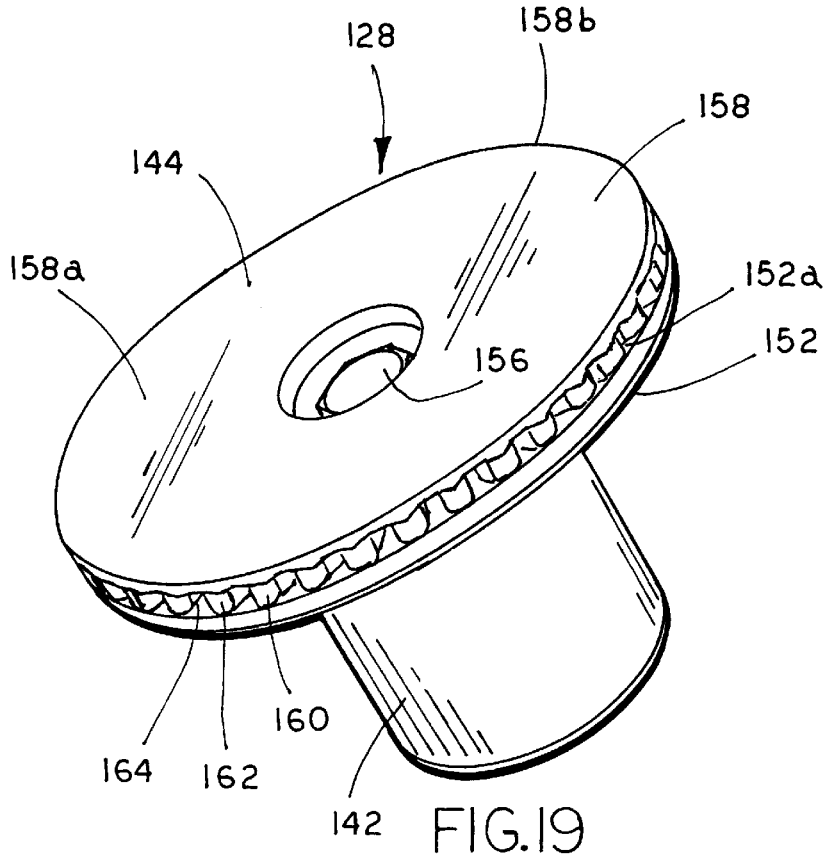
FIG. 19 is a perspective view of a second embodiment of the nozzle of the floor fire suppressant system of the present invention.

Referring to FIG. 19, a second embodiment 128 of a nozzle of the present invention is illustrated. Nozzle 128 includes a base 142 and a deflector 144 which is mounted on a central web support 146 (FIG. 22) by a retaining fastener 156, similar to the previous embodiment. Deflector 144 is similarly a solid deflector and includes a plurality of spray teeth 160 which project downwardly, toward base 142 and are formed by rounded plate members 162. Preferably, spray teeth 160 rest on base 142 and form passageways 164 to provide a generally lateral radial uniform spray pattern as previously described. For further details of teeth 160 reference is made to the first embodiment.

Similar to the previous embodiment, body 142 includes transverse passage 147 with a threaded inlet 150 which defines an inlet opening 148 and an outlet opening 154. Body 142 also includes a base or body flange 152 which extends around outlet opening 154. Spray teeth 160 extend between deflector flange 158 and body flange 152 and rest on upper surface 152*a* of flange 152 which together with web 146 provide uniform support to deflector flange 158. Spray teeth 160 are arranged in a similar manner to spray teeth 60 and, therefore, reference is made to the first embodiments for further details.

Figure 21:
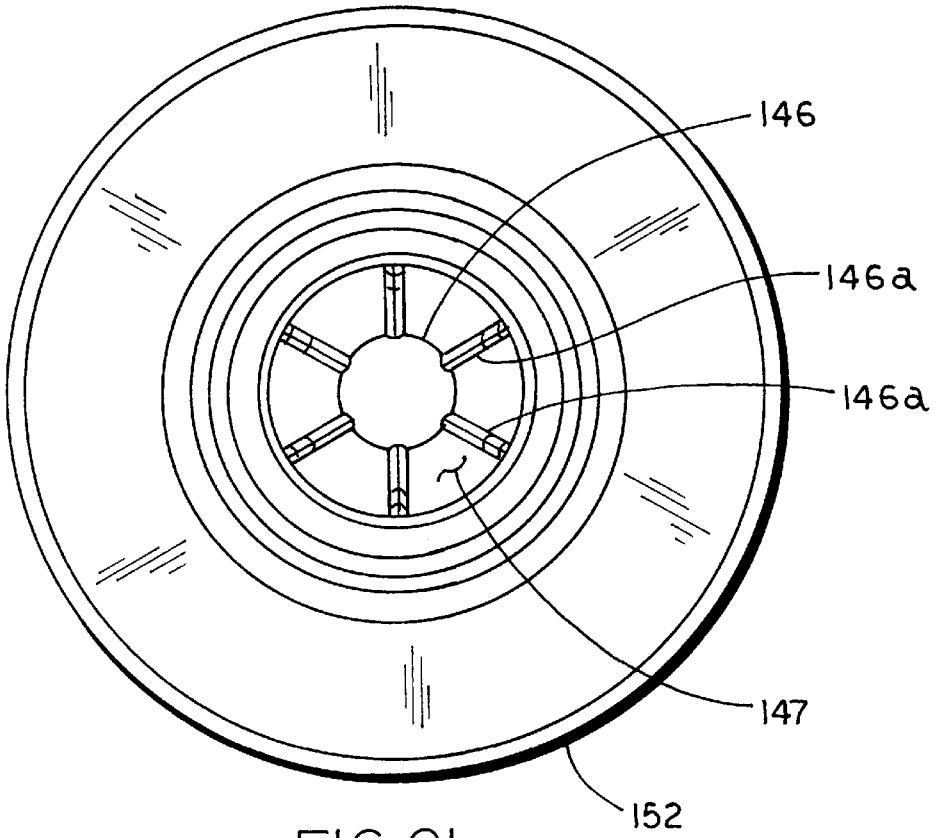
FIG. 21 is a bottom plan view of the nozzle of FIG. 20 as viewed from the inlet opening.
Figure 22:
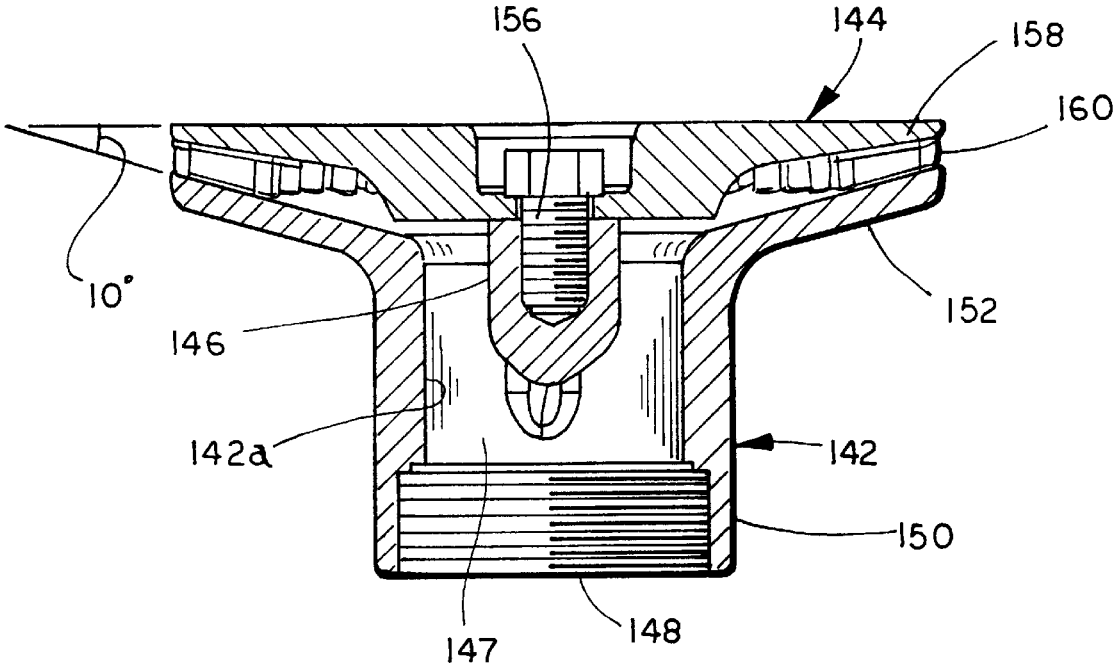
FIG. 22 is a cross-section view taken along line XXII—XXII of FIG. 20.
Figure 23:
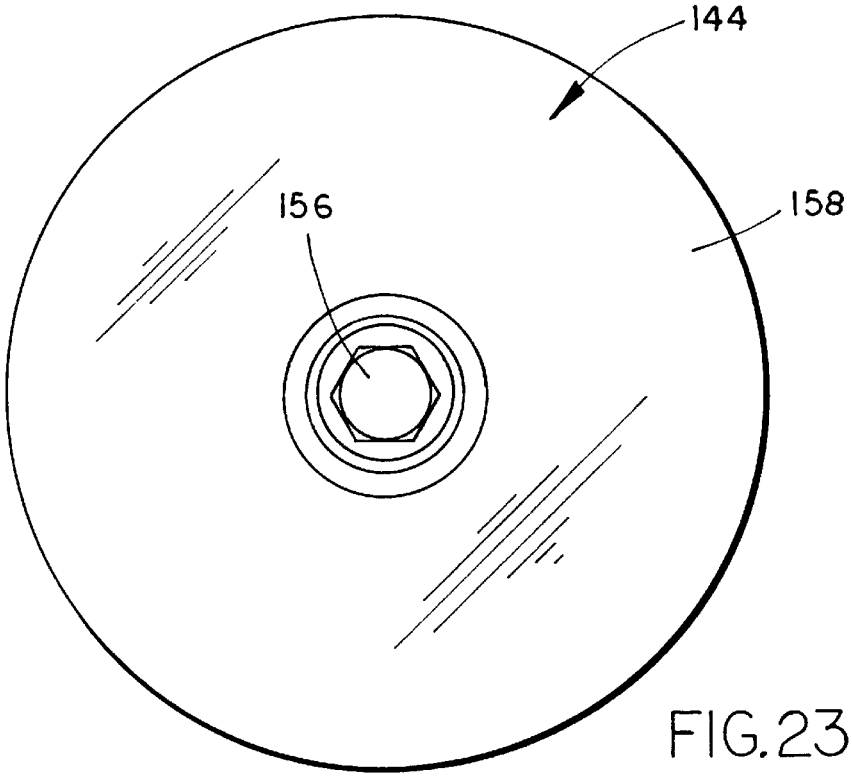
FIG. 23 is a top plan view of the deflector of the nozzle of FIG. 19.

Referring to FIGS. 21 and 22, base 142 includes a center support web 146 which includes a plurality of support arms 146*a* which extend to inner surface 142*a* of body 142. In the illustrated embodiment, deflector 144 includes an enlarged mounting web 174 which increases the flow rate of the fire suppressant into passageways 162 to increase the spray pattern for a given inlet supply pressure.

As should be understood from the description of nozzle 28, nozzle 128 is similarly positioned in grating 22 in a manner such that upper surface 158*a* of flange 158 is substantially flush with upper surface 36 of base 32 and, furthermore, generally flush with the upper surface 16 of the floor area 14.

Figure 24:
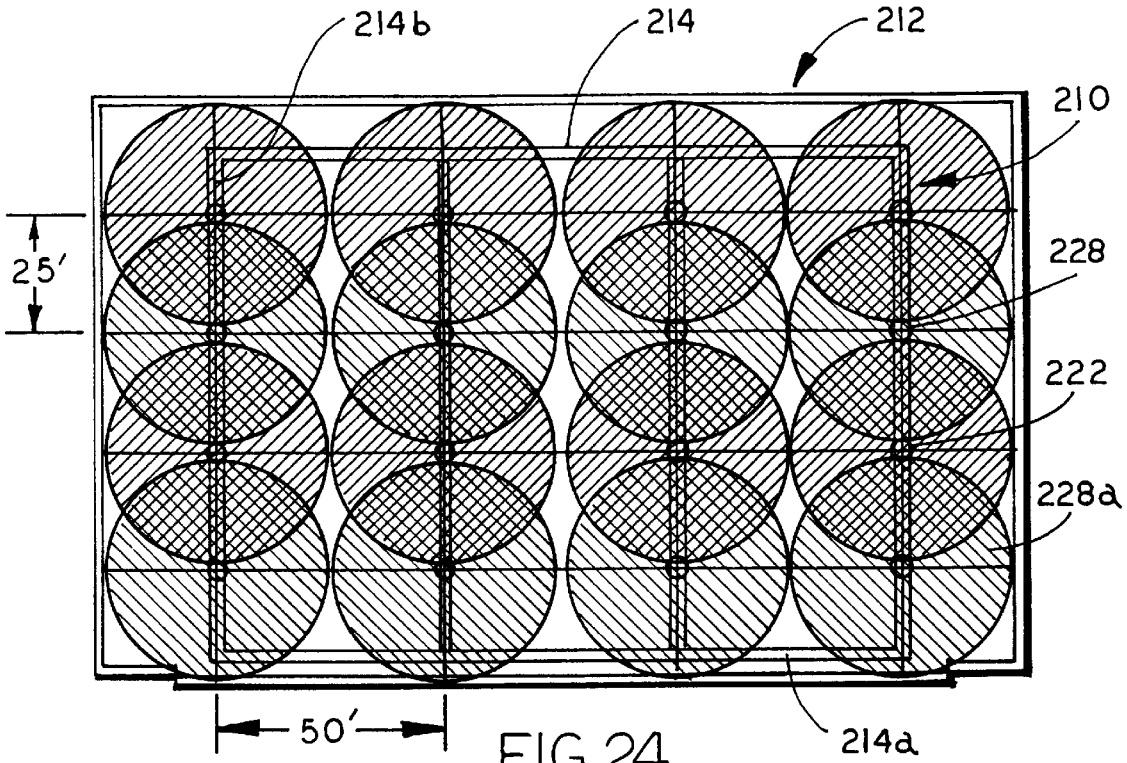
FIG. 24 is a plan view of an air hanger similar to FIG. 1 illustrating a floor area with a trench covered by floor grating of the fire suppressant system of the present invention and further illustrating the spray pattern of the respective nozzles of the fire suppressant system.

Referring to FIG. 24, a second arrangement of a floor area 212 is illustrated. Floor area 212 includes a trench 214 which includes a perimeter trench wall 214*a* and four transverse trench walls 214*b*. The arrangement illustrated in FIG. 24 is particularly suitable for a hanger which has a floor area of 200 feet by 100 feet. Positioned in trench 214 is a second embodiment of the floor fire suppressant system 210 of the present invention. In the illustrated embodiment, floor fire suppressant system 210 includes a plurality of nozzles 228 which are supported by respective gratings 222 over trench 214 and are spaced approximately 25 feet on center along the transverse trench portions 214*b* and approximately 50 feet on center between adjacent transverse trench portions 214*b*. In this manner, spray 228*a* generated by each respective nozzle provides varying degrees of overlap with the adjacent nozzles and covers the entire floor area 212 of the target area.

Figure 27:
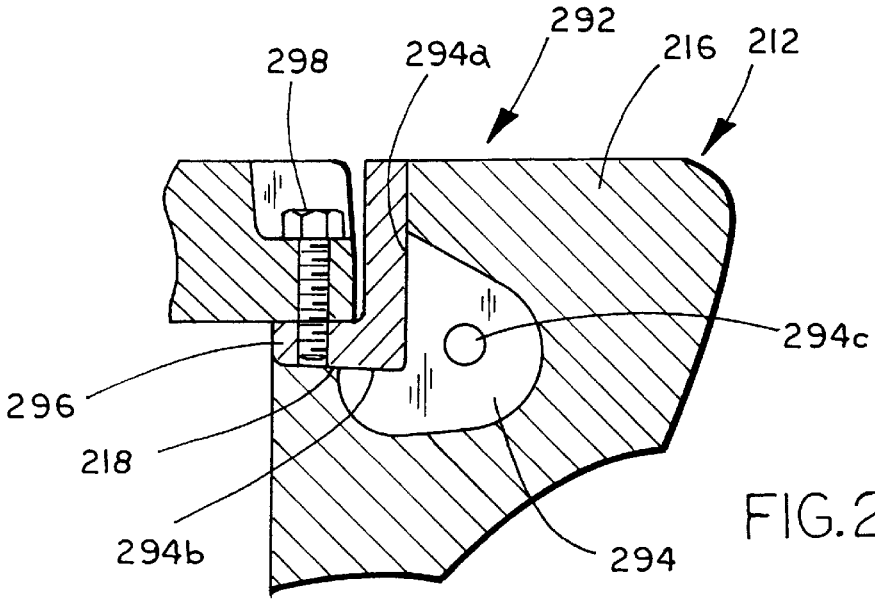
FIG. 27 is an enlarged view of the mounting system of the grate identified by the area XXVII in FIG. 26.
Figure 8:
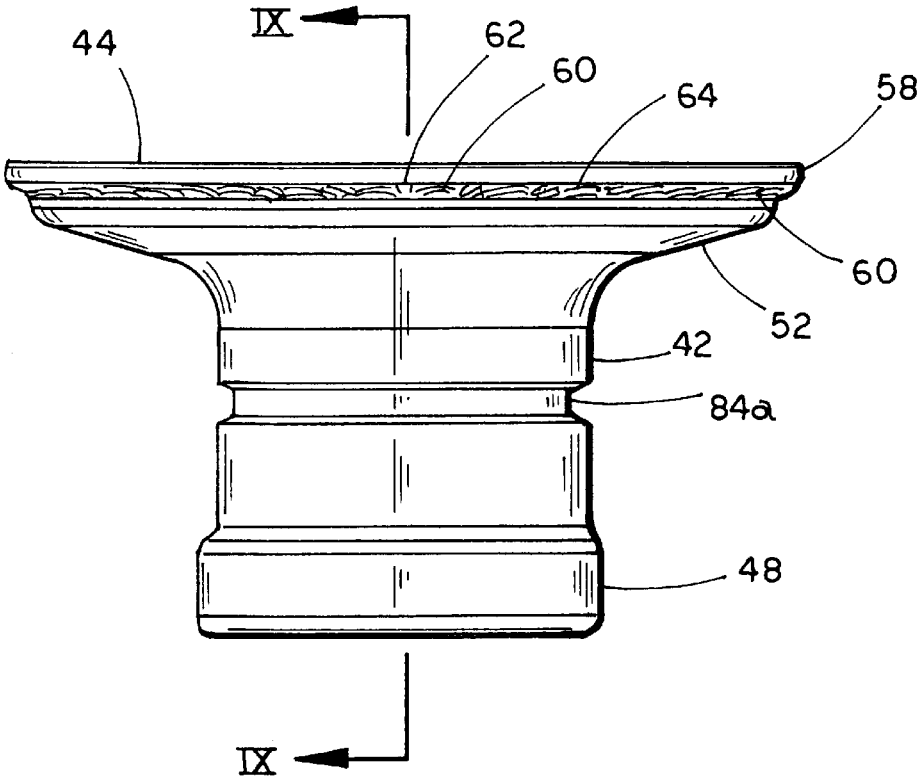
FIG. 8 is an elevation view of the nozzle of FIG. 6.
Figure 25:
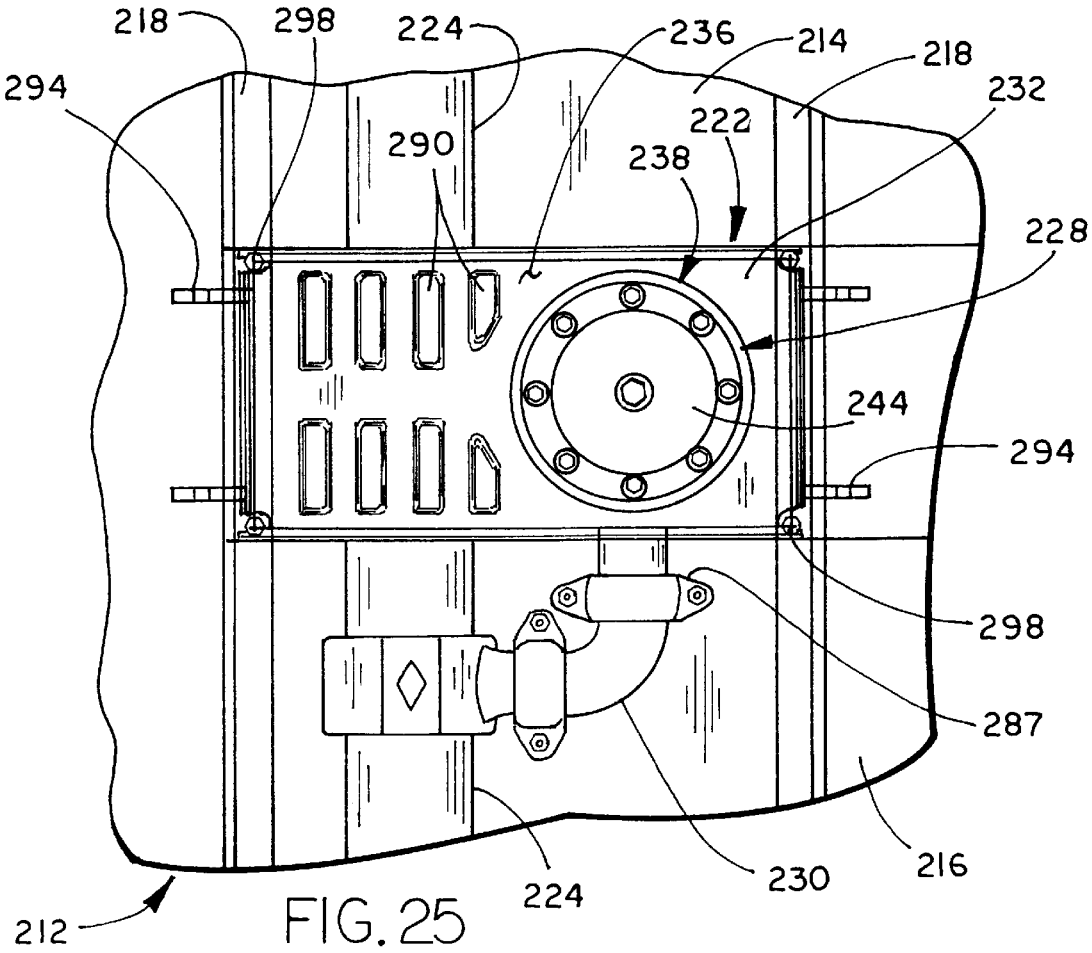
FIG. 25 is an enlarged plan view of a section of the trench illustrating a nozzle and floor grating assembly installed over the trench, with the remaining grating removed for clarity.

Referring to FIG. 25, grating 228 extends over trench 214 is supported on respective shelves 218 and anchored to shelves 218 by an "X" frame system, which is conventionally known and will be more fully described in reference to FIG. 27. Similar to floor grating 22, floor grating 222 includes a generally solid base 232 which spans over trench 214 and rests on shelves 218. Similar to the previous embodiment, grating 222 is preferably supported on shelves 218 so that upper surface 236 of body 232 is substantially flush with the upper surface 216 of the floor area 212. Grating 222 supports nozzle 228 such that upper surface of the nozzle's deflector 244 is substantially flush with upper surface 236 of body 232 and also with surface 216 of floor area 212.

Figure 34:
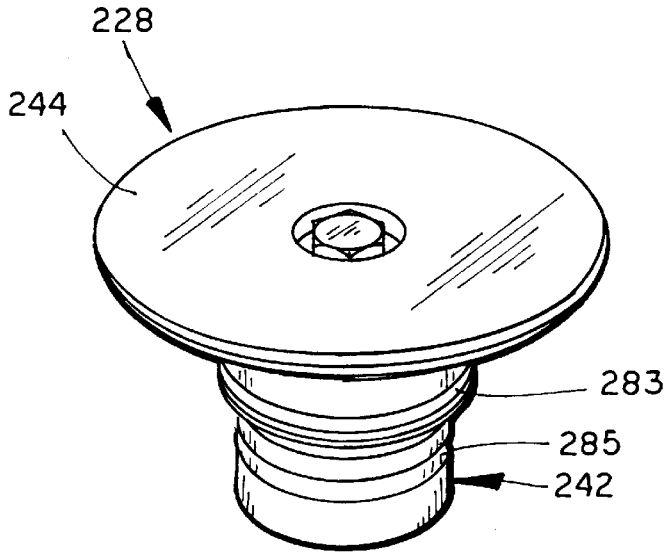
FIG. 34 is a perspective view of another third embodiment of the nozzle of the present invention.
Figure 35:
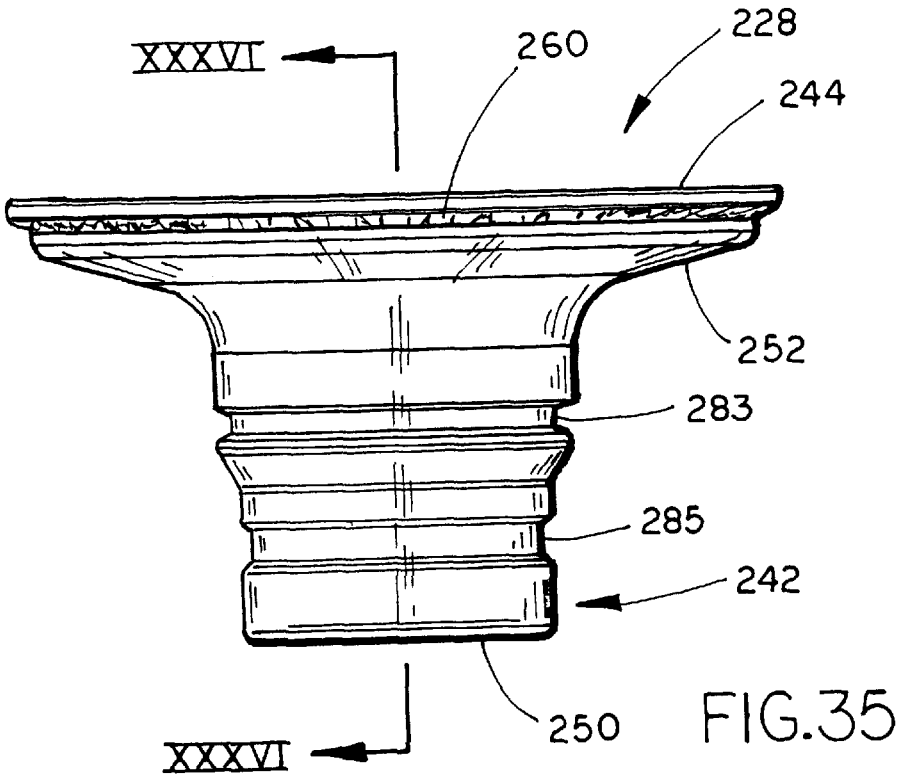
FIG. 35 is an elevation view of the nozzle of FIG. 34.
Figure 36:
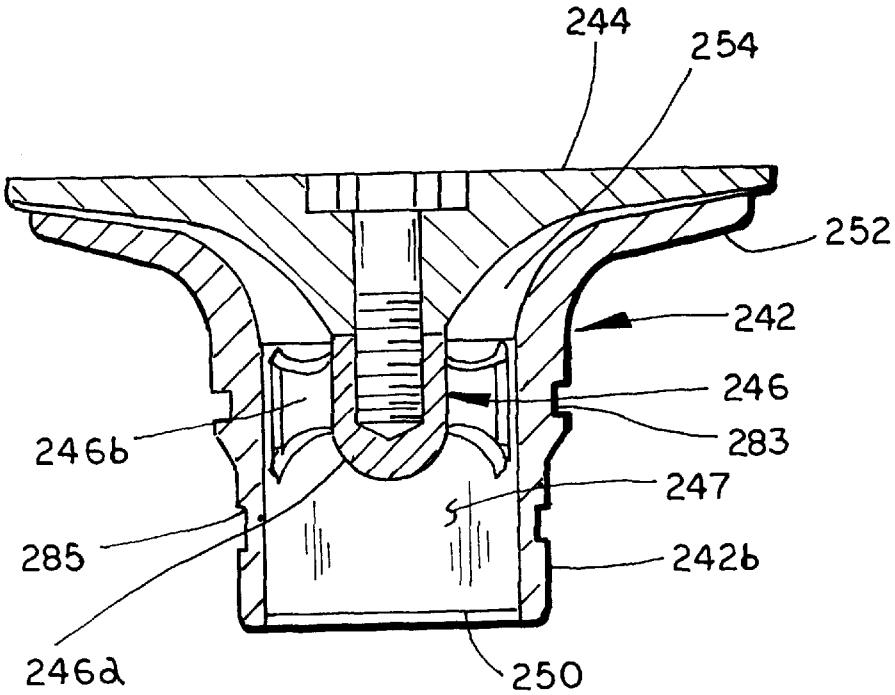
FIG. 36 is a cross-section view taken along line XXXVI of FIG. 35.

Referring to FIGS. 34–36, nozzle 228 includes deflector 244 which is supported and mounted to base or body 242. Deflector 244 is of similar construction to deflector 44 described in reference to the first embodiment and includes a plurality of projecting members 260 similar to projecting members 60 of the first embodiment. Reference is made to the first embodiments for further details of deflector 244. Base 242 is also similar to the base or body 42 of the first embodiment and includes a transverse passage 247 which defines an inlet opening 250 and an outlet opening 254 and, further, includes a flange 252 which extends around outlet opening 254. Positioned in passage 247 is a central web 246 which includes a central body 246*a* and a plurality of support arms 246*b* which extend to cylindrical wall 242*b* of body 242. Reflector 244 is supported on base 242 or central web 246 and, further, by projecting members 260 which rest on flange 252.

In the illustrated embodiment, cylindrical wall 242*b* includes a first annular groove 283, similar to annular groove 83, and a second annular groove 285. Groove 283 is for securing nozzle 228 in grating 222 as described in reference to groove 83. Groove 285 receives a grooved coupler 287, which couples body 242 to a fire suppressant supply line 230, which couples to a larger system fire suppressant supply line 224 supported in trench 214. Further description of groove couplings 287 are not provided here as they are conventional and well known in the art.

Figure 26:
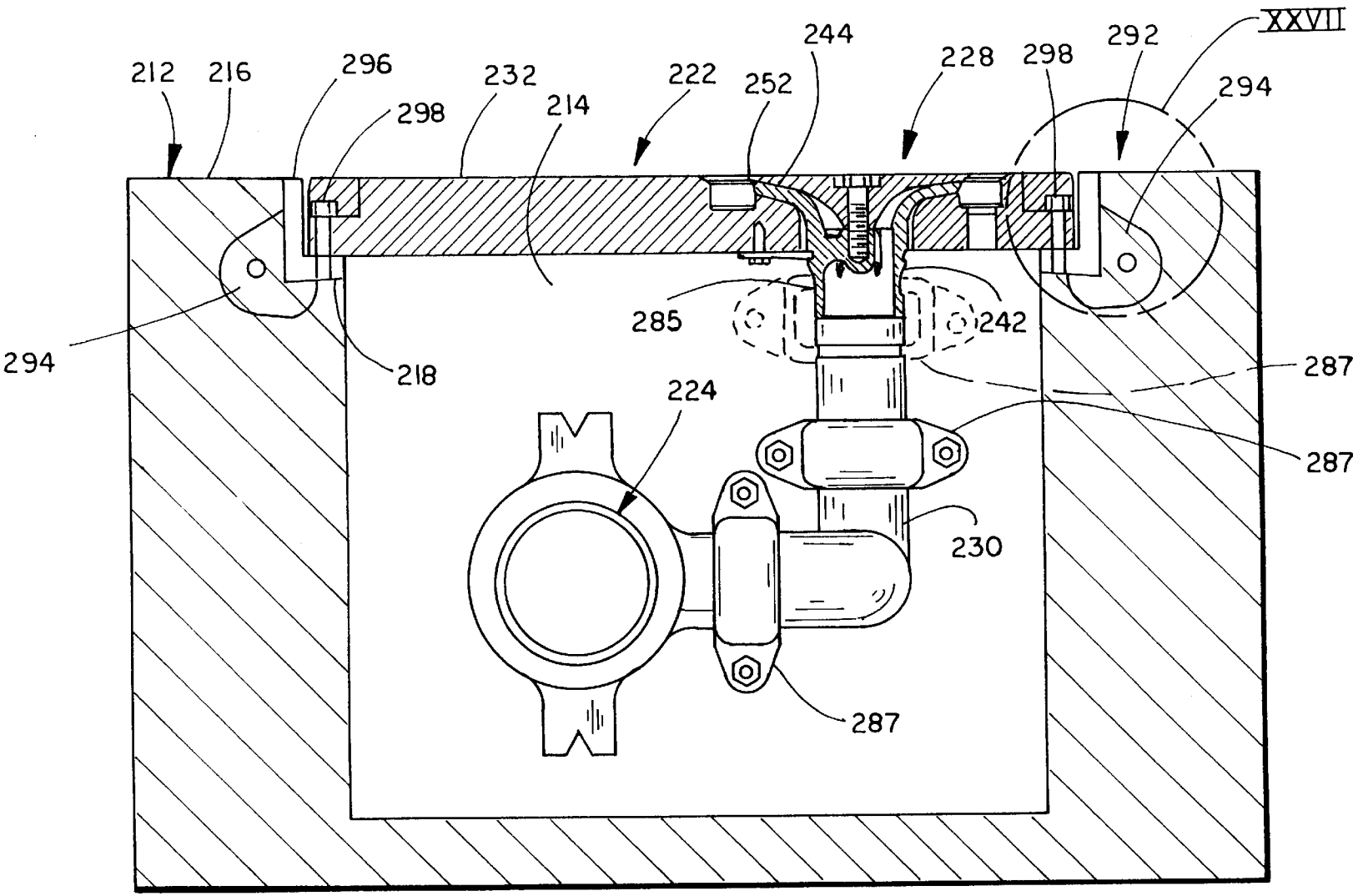
FIG. 26 is a cross-section view taken along line XXVI—XXVI of FIG. 25.
Figure 30:
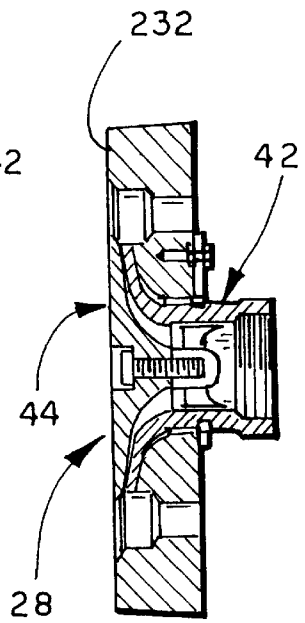
FIG. 30 is a cross-section view similar to FIG. 29 illustrating the grating assembly supporting the first embodiment of the nozzle.
Figure 29:
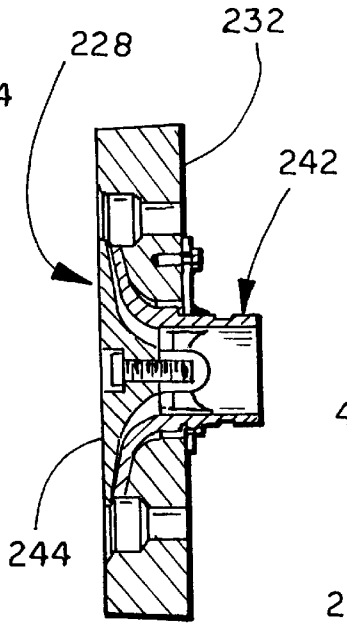
FIG. 29 is a cross-section view taken along line XXIX of FIG. 28.
Figure 31:
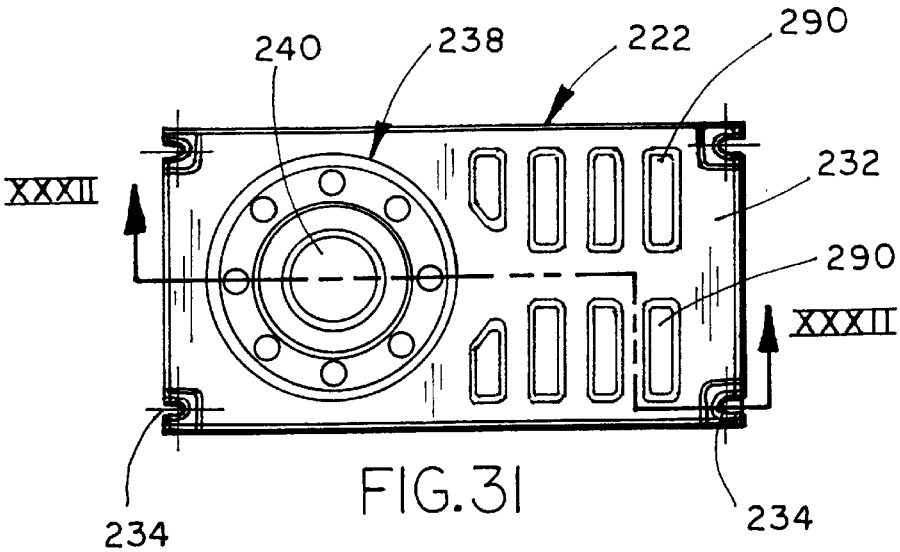
FIG. 31 is a plan view of the grating of FIG. 25 rotated 180° with the nozzle removed.
Figure 31A:
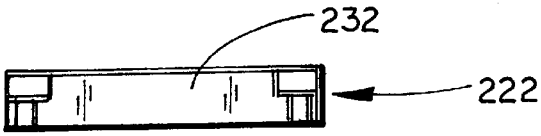
FIG. 31A is an end elevation view of the grating of FIG. 31.
Figure 32:
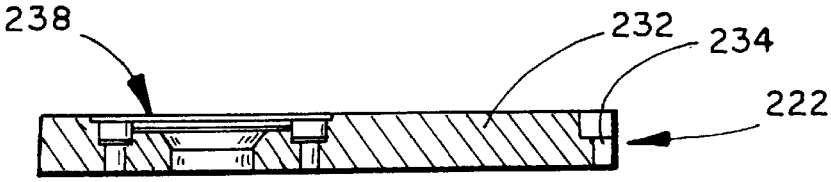
FIG. 32 is a cross-section view taken line XXII of FIG. 31.
Figure 33:
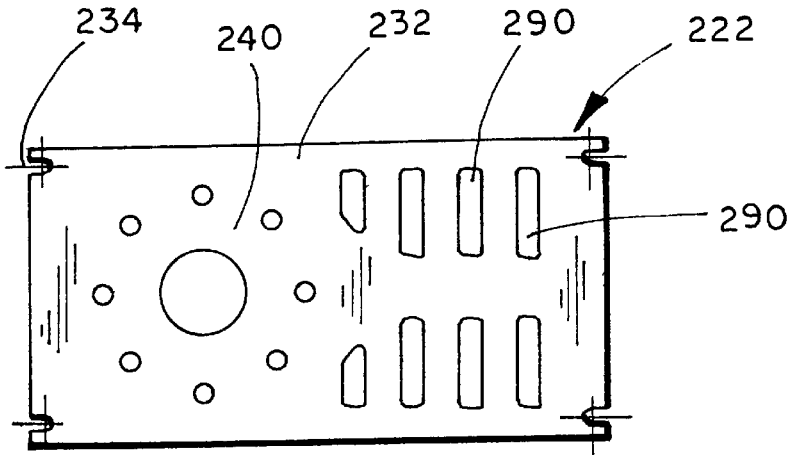
FIG. 33 is a bottom plan view of the grating of FIG. 31.

Referring to FIGS. 26 and 31, grating 222 includes a recessed portion 238 with a transverse opening 240 extending therethrough. Nozzle 228 is supported in recessed cavity 238 with body 242 extending through opening 240 to couple to supply lines 230 and 224. For further description of cavity 238, reference is made to the first embodiment. In the illustrated embodiment, recessed portion 238 is laterally offset from the center of base 232 to facilitate the piping and further to reduce the weight of grate 222. In order to reduce the weight of grating 222, base 232 includes a plurality of openings 290 adjacent recessed cavity 238. Openings 290 extend through base 232 to reduce the mass of body 232 and further provide drainage paths for excess fire suppressant and loose debris. In the illustrated embodiment, openings 290 comprise elongated openings and provide a significant reduction in weight of grating 222.

Figure 28:
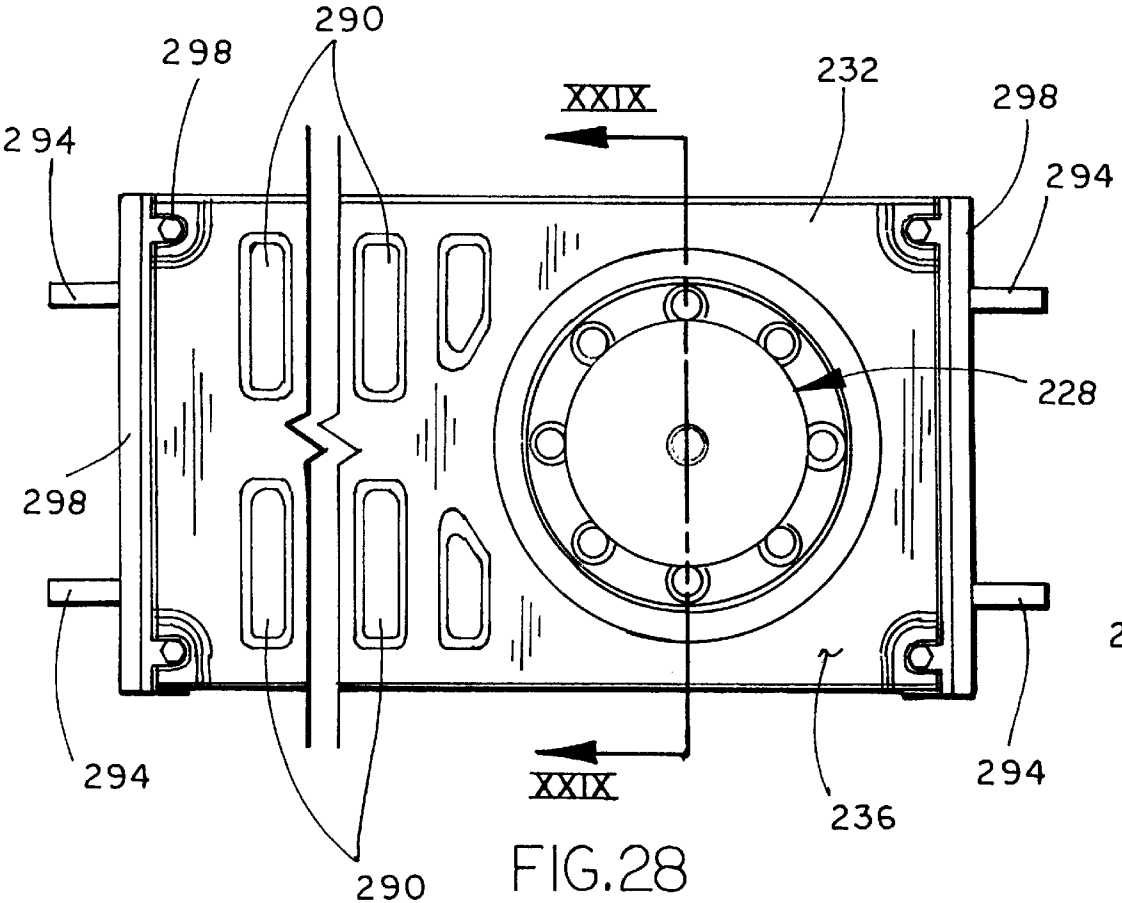
FIG. 28 is an enlarged fragmentary plan view of the nozzle and grating assembly illustrated in FIG. 25.

Referring again to FIG. 26, as previously noted, grating 222 is mounted to shelf 218 by a "X" frame system 292. Referring to FIG. 27, "X" frame system includes a pair of metal mounting tabs or angle arms 294 (FIG. 28) which are set in the concrete forming floor 212 and include legs 294*a* and 294*b* which align with the vertical and horizontal walls of shelf 218. "X" frame system 292 further includes a metal mounting angle member 296 which is welded to legs 294*a* and 294*b* of the respective angle arms 294. Extending transversely through corresponding openings 294*c* of angle arms 294 is a rod or re-bar 298, which is also set in the concrete forming floor 212. Grating body 232 is mounted to mounting angle arms 296 by threaded fasteners, such as bolts 298, which extend through slotted recessed mounting opening 234 of body 232 which are positioned at opposed corners of body 232 and into corresponding threaded openings provided in angle arm 294. Thus grating 222 is rigidly mounted and anchored to floor 212 on shelves 218. It should be understood, that other conventional mounting arrangements may be used.

It should be understood from the foregoing that the floor fire suppressant system of the present invention provides a fire suppressant delivery system which is capable of producing a generally lateral radial spray pattern while minimizing the height of the spray pattern to avoid contact with the vehicles or equipment which are supported on the floor area. Due to the multiple locations and low profile of the spray pattern, vehicles and aircraft in the area will not pose obstructions to the delivery of the fire suppressant. Furthermore, since the nozzles of the system are located generally flush with the floor area and the grating and nozzles are designed to support at least a portion of the aircraft or vehicle weight, even when the vehicle or equipment is parked over nozzle, aircraft or other vehicles can pass over the nozzles and fire suppressant system with substantially no effect. While the nozzle will still operate, at least on a restricted basis, coverage will not be impaired and will be compensated by adjacent nozzles to provide adequate protection. In addition, each nozzle produces a high velocity water or foam solution flow that results in multiple droplet sizes which provides a solid pattern and uniform distribution of the water or foam solution.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

What is claimed is:

1. A floor fire suppressant system for a floor area of an aircraft facility, said floor fire suppressant system comprising:

a floor grating for positioning over a trench of the floor area;

a nozzle having a body with a transverse passage defining an inlet opening and an outlet opening, said inlet opening for communicating with a fire suppressant supply pipe, said nozzle being supported by said floor grating and including a deflector supported on said body for dispersing fire suppressant exiting from said outlet opening in a generally lateral radial pattern, and said deflector being adapted to carry at least a portion of the weight of an aircraft riding over said deflector.

2. The floor fire suppressant system according to claim 1, wherein said floor grating includes a base, said base being sized for spanning over the trench, said base including a recessed portion and a transverse opening extending through said recessed portion, said body of said nozzle being supported in said recessed portion, and said inlet opening communicating with the supply pipe through said transverse opening.

3. The floor fire suppressant system according to claim 2, wherein a portion of said body of said nozzle extending through said transverse opening for communicating with the fire suppressant supply pipe.

4. The floor fire suppressant system according to claim 1, wherein said body includes a body flange, said body flange resting on said recessed portion.

5. The floor fire suppressant system according to claim 1, wherein said base includes an upper surface, said deflector including a deflector flange, and said deflector flange being generally flush with said upper surface when said body is supported in said recessed portion.

6. The floor fire suppressant system according to claim 5, wherein said deflector flange is substantially solid to provide a deflecting surface for fire suppressant.

7. The floor fire suppressant system according to claim 5, wherein said recessed portion includes an outer perimeter, said deflector flange having an outer perimeter spaced radially inward of said outer perimeter of said recessed portion to provide a passageway therebetween for the fire suppressant to flow through to form the lateral radial pattern.

8. The floor fire suppressant system according to claim 7, wherein said recessed portion includes a tapered outer perimeter portion.

9. The floor fire suppressant system according to claim 8, wherein said outer tapered portion is angled in a range of 5° to 20° with respect to said upper surface of said base.

10. The floor fire suppressant system according to claim 9, wherein said tapered portion is angled about 15° with respect to said upper surface of said base.

11. The floor fire suppressant system according to claim 10, wherein said deflector includes a deflector flange and a plurality of projecting members extending from said deflector flange toward said outlet opening, said projecting members being radially spaced around said outlet opening to form a plurality of radial passageways through which the fire suppressant flows to disperse the fire suppressant exiting said outlet opening in a generally lateral radial pattern for delivering fire suppressant to the floor area.

12. The floor fire suppressant system according to claim 11, wherein said projecting members rest on said body.

13. The floor fire suppressant system according to claim 12, wherein said deflector flange includes an outer perimeter, said projecting members extending inwardly from said outer perimeter.

14. The floor fire suppressant system according to claim 11, wherein each of said projecting members includes a lateral extent, each lateral extent being aligned along a radial line extending outwardly from said outlet opening.

15. The floor fire suppressant system according to claim 14, wherein each of said projecting members includes first and second ends, said first ends being radially inward of said second ends, and said first ends being radiused to produce a venturi effect to disperse the fire suppressant from said outlet opening with a uniform distribution.

16. The floor fire suppressant system according to claim 15, wherein said second ends are radiused to disperse the fire suppressant in a uniform distribution.

17. The floor fire suppressant system according to claim 16, wherein said second ends are generally aligned with an outer perimeter of said deflector flange.

18. The floor fire suppressant system according to claim 15, wherein each of said projecting members comprises an elongate plate member.

19. The floor fire suppressant system according to claim 11, wherein said deflector includes a plurality of projecting members projecting toward said outlet opening, said projecting members being radially spaced around said outlet opening to form a plurality of passageways through which the fire suppressant flow to disperse the fire suppressant exiting said outlet opening in a generally lateral radial pattern for delivering fire suppressant to a floor area.

20. The floor fire suppressant system according to claim 11, said deflector having a generally solid deflector flange, said body including a body flange, and said projecting members extending between said deflector flange and said body flange.

21. The floor fire suppressant system according to claim 20, wherein said projecting members rest on said body flange.

22. The floor fire suppressant system according to claim 19, wherein each of said projecting members comprises elongate fingers, each of said elongate fingers being aligned along a respective radial line extending outwardly from said outlet opening.

23. The floor fire suppressant system according to claim 22, wherein each of said fingers includes radiused first and second ends to produce a venturi effect to disperse the fire suppressant in a uniform distribution, said first ends being radially inward of said second ends toward said outlet opening.

24. A floor fire suppressant system for a floor area of an aircraft facility, said fire suppressant system comprising:

a supply pipe for positioning in a trench of the floor area;

a floor grating for positioning over said trench and being positioned over said pipe; and a nozzle having a body with a transverse passage defining an inlet and an outlet opening, said inlet in communication with said pipe, said pipe delivering fire suppressant to said nozzle, said nozzle being supported by said floor grating and including a deflector supported on said body for dispersing the fire suppressant exiting from said outlet opening in a generally lateral radial pattern, and said nozzle being adapted to carry at least a portion of the weight of an aircraft riding over said nozzle.

25. The floor fire suppressant system according to claim 23, wherein said deflector includes a deflector flange and said body includes a body flange, said nozzle further having a plurality of projecting members extending from said deflector flange toward said body flange.

26. The floor fire suppressant system according to claim 23, wherein said projecting members are radially spaced around said outlet opening to form a plurality of radial passageways through which the fire suppressant exiting said outlet opening flows in a generally lateral radial pattern for delivering fire suppressant to the floor area.

27. The floor fire suppressant system according to claim 26, wherein said projecting members rest on said body flange.

28. The floor fire suppressant system according to claim 27, wherein each of said projecting members includes a planar bearing surface.

29. The floor fire suppressant system according to claim 28, wherein each of said projecting members is aligned along a respective radial line extending outwardly from said outlet opening.

30. The floor fire suppressant system according to claim 29, wherein each of said projecting members includes radiused first and second ends, said first ends being radially inward of said second ends toward said outlet opening.

31. The floor fire suppressant system according to claim 30, wherein said floor grating includes a base for spanning the trench, said base including a recessed portion and a transverse opening, said body flange resting on said recessed portion, and said nozzle in communication with said pipe through said transverse opening.

32. The floor fire suppressant system according to claim 22, wherein said base includes a plurality of drainage openings extending therethrough.

33. The floor fire suppressant system according to claim 32, wherein said recessed portion includes a plurality of said drainage openings, said drainage openings being arranged around said nozzle whereby excess water and debris may be drained through said floor grating to avoid obstruction to said nozzle.

34. The floor fire suppressant system according to claim 32, wherein said recessed portion includes an annular groove, said drainage openings provided in said annular groove.

35. The floor fire suppressant system according to claim 33, wherein said recessed portion includes a tapered peripheral portion extending around said nozzle to permit unobstructed dispersion of the fire suppressant from said nozzle.

* * * * *